US011105541B2

(12) United States Patent
Kim et al.

(10) Patent No.: US 11,105,541 B2
(45) Date of Patent: Aug. 31, 2021

(54) REFRIGERATOR

(71) Applicant: LG ELECTRONICS INC., Seoul (KR)

(72) Inventors: Seokhyun Kim, Seoul (KR); Minkyu Oh, Seoul (KR); Heayoun Sul, Seoul (KR); Hyoungkeun Lim, Seoul (KR); Jeehoon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 168 days.

(21) Appl. No.: 15/918,063

(22) Filed: Mar. 12, 2018

(65) Prior Publication Data

US 2018/0266735 A1 Sep. 20, 2018

(30) Foreign Application Priority Data

Mar. 14, 2017 (KR) ..... 10-2017-0031977

(51) Int. Cl.
*F25B 21/04* (2006.01)
*F25B 21/02* (2006.01)
(Continued)

(52) U.S. Cl.
CPC ..... *F25B 21/04* (2013.01); *F25B 21/02* (2013.01); *F25B 47/02* (2013.01); *F25D 17/062* (2013.01);
(Continued)

(58) Field of Classification Search
CPC ..... F25B 21/04; F25B 47/02; F25B 21/02; F25B 2321/0251; F25B 2321/0211;
(Continued)

(56) References Cited

U.S. PATENT DOCUMENTS 5,448,891 A * 9/1995 Nakagiri ..... F24F 5/0042 62/3.1
5,927,078 A 7/1999 Watanabe et al.
(Continued)

FOREIGN PATENT DOCUMENTS

KR 10-1997-0002215 1/1997
KR 10-2010-0057216 5/2010

OTHER PUBLICATIONS

U.S. Appl. No. 15/918,292, filed Mar. 12, 2018, Edward F. Landrum.
(Continued)

*Primary Examiner* — Cassey D Bauer
(74) *Attorney, Agent, or Firm* — KED & Associates LLP

(57) ABSTRACT

A refrigerator may include a temperature sensor, a thermoelectric device module having a thermoelectric device, and at least one fan and configured to cool a storage compartment, and a controller that controls the output power of the thermoelectric device based on the temperature of the storage compartment, a set temperature, and the outside temperature. The output power of the thermoelectric device may be determined based on whether the temperature of the storage compartment is within a first temperature region including the set temperature, a second temperature region, or a third temperature region. In the first and second temperature regions, the thermoelectric device may operate at different output power and which gradually increases as the outside temperature increases. In the third temperature region, the thermoelectric device may operate at a third output power which exceeds the first output power and is greater than or equal to the second output power.

19 Claims, 7 Drawing Sheets

(51) Int. Cl.
*F25B 47/02* (2006.01)
*F25D 21/06* (2006.01)
*F25D 17/06* (2006.01)

(52) U.S. Cl.
CPC ..... *F25D 21/06* (2013.01); *F25B 2321/0211* (2013.01); *F25B 2321/0212* (2013.01); *F25B 2321/0251* (2013.01); *F25B 2700/2104* (2013.01); *F25B 2700/2106* (2013.01); *F25B 2700/2107* (2013.01); *F25D 2700/12* (2013.01); *F25D 2700/14* (2013.01)

(58) Field of Classification Search
CPC ..... F25B 2700/2107; F25B 2700/2106; F25B 2700/2104; F25B 2321/0212; F25D 17/062; F25D 21/06; F25D 2700/14; F25D 2700/12
See application file for complete search history.

(56) References Cited

U.S. PATENT DOCUMENTS

2002/0194856 A1 12/2002 Yeo
2003/0115892 A1 6/2003 Fu
2008/0000242 A1 1/2008 Jung
2008/0022696 A1* 1/2008 Welle ..... F25B 21/04 62/3.7
2008/0078187 A1 4/2008 Ye et al.
2011/0016887 A1 1/2011 Lee et al.
2012/0047911 A1 3/2012 Bhavsar et al.
2012/0312030 A1 12/2012 Lu
2013/0139524 A1* 6/2013 Kim ..... F25B 21/02 62/3.7
2015/0075184 A1* 3/2015 Edwards ..... F25B 21/02 62/3.2
2015/0239322 A1* 8/2015 Yokoo ..... F25B 5/04 62/158
2016/0018141 A1* 1/2016 Edwards ..... F25B 21/04 62/3.3
2017/0057323 A1* 3/2017 Neu ..... F25B 49/02

OTHER PUBLICATIONS

U.S. Appl. No. 15/918,292, filed Mar. 12, 2018.
European Search Report dated Aug. 6, 2018 issued in Application No. 18161701.0.
European Search Report dated Aug. 13, 2018 issued in Application No. 18161683.0.

* cited by examiner

REFRIGERATOR

CROSS-REFERENCE TO RELATED APPLICATION

This application claims priority under 35 U.S.C. § 119 to Korean Application No. 10-2017-0031977, filed on Mar. 14, 2017, whose entire disclosure is hereby incorporated by reference.

BACKGROUND

1. Field

The present disclosure relates to a refrigerator having a thermoelectric device that exhibits high refrigeration performance and method of controlling the same.

2. Background

Refrigerators having thermoelectric devices and methods of controlling the same are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
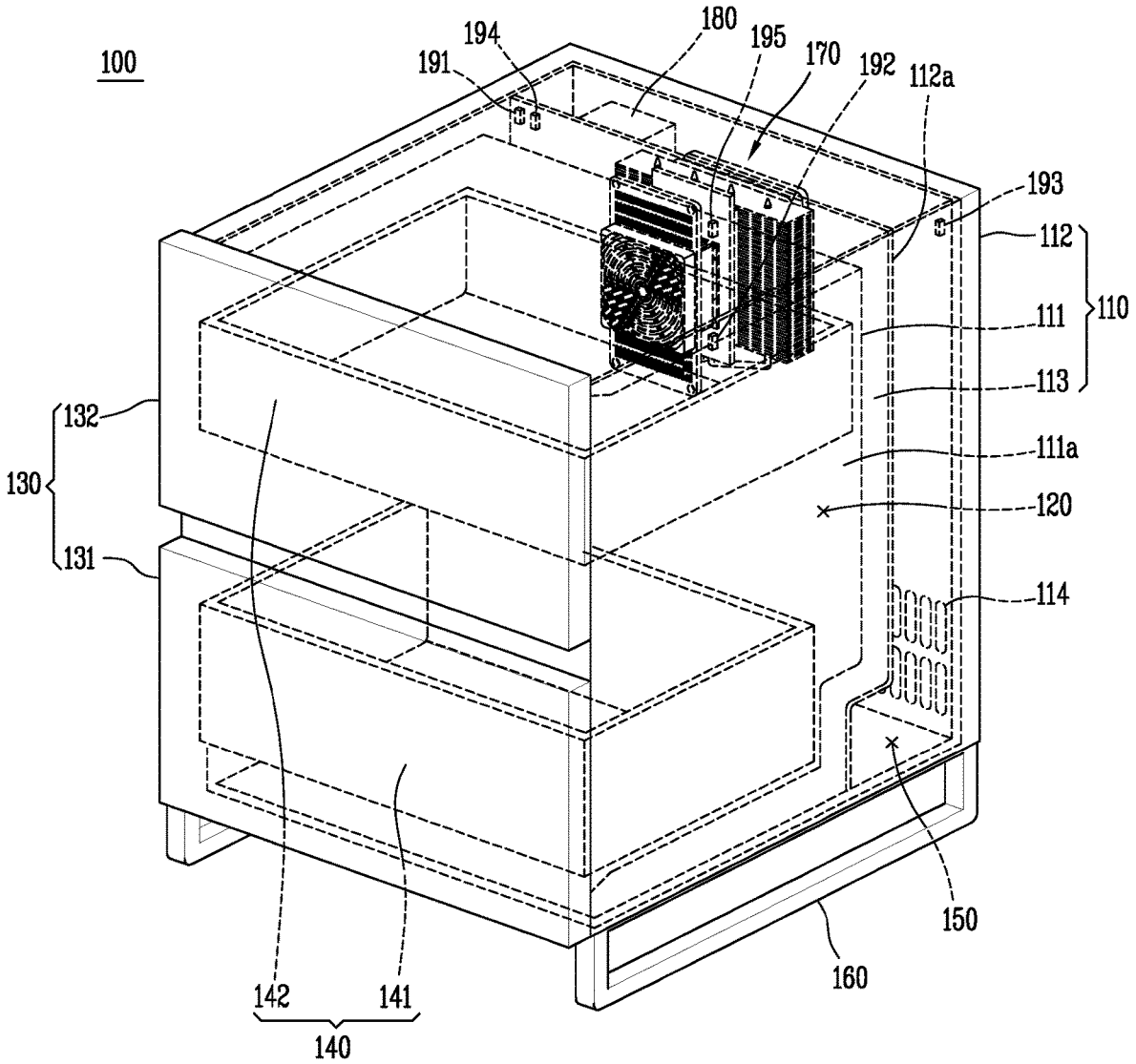
FIG. 1 is a conceptual diagram showing an example of a refrigerator having a thermoelectric device module.

Hereinafter, a refrigerator and a method of controlling the refrigerator according to the present disclosure will be described in more detail with reference to the drawings. In this specification, the same or similar components in different embodiment are assigned the same or similar reference numerals, and redundant descriptions will be omitted. Singular expressions include plural referents unless clearly indicated otherwise in the context.

A thermoelectric device refers to a device that absorbs and generates heat using the Peltier effect. The Peltier effect is a phenomenon in which, when a voltage is applied to two ends of the device, heat is absorbed at one of the two sides and heat is generated at the other side, depending on the direction of current. This thermoelectric device may be used in a refrigerator in place of refrigeration cycle equipment.

Generally, a refrigerator is an appliance including a food storage space that can block heat coming from the outside by a cabinet and doors, inside of which is filled with insulation, and a refrigeration device including an evaporator that absorbs heat from the food storage space and a heat sink that dissipates collected heat out of the food storage space. In this manner, the food storage space may be refrigerated enabling it to store food for a long period of time without spoiling by keeping the food storage space at low temperatures which make microbial survival and growth difficult.

The refrigerator may be divided into a refrigerator compartment that stores food at above-freezing temperatures and a freezer compartment that stores food at below-freezing temperatures. The refrigerator may be classified as a top freezer refrigerator with a top freezer and a bottom refrigerator, a bottom freezer refrigerator with a bottom freezer and a top refrigerator, a side-by-side refrigerator with a left freezer and a right refrigerator, etc., depending on the placement of the refrigerator compartment and the freezer compartment. In order for the user to stock food in the food storage space or take it out with ease, the refrigerator may have a plurality of shelves and drawers in the food storage space.

In a case where a cooling device for cooling the food storage space is implemented as a cooling cycle device that includes a compressor, a condenser, an expander, an evaporator, etc., it is difficult to block out vibration and noise generated by the compressor. The noise and vibration are an inconvenience to the user and undesirable—especially in recent times, when refrigerators are often installed in living rooms, bedrooms, etc., as pieces of functional furniture or cosmetic refrigerators as well as in kitchens.

By using a thermoelectric device in a refrigerator, the food storage space may be cooled without need for a refrigeration cycle device. Notably, the thermoelectric device does not generate noise and vibration, as opposed to the compressor. Thus, the thermoelectric device, when used in a refrigerator, can solve the problem of noise and vibration, even when the refrigerator is installed somewhere other than the kitchen.

Various refrigerators having thermoelectric devices and methods of controlling the same are known. However, they suffer from various disadvantages. Cooling power that can be obtained using a thermoelectric device is smaller than that obtained from a refrigeration cycle device. Moreover, because the thermoelectric device has unique features that are distinct from the refrigeration cycle device, a cooling operation method used in a refrigerator with a thermoelectric device should be different from that used in a refrigerator with a refrigeration cycle device.

These and other disadvantages of refrigerators having thermoelectric devices are addressed in the present disclosure. An aspect of the present disclosure is to propose a control method suitable for a refrigerator with a thermoelectric device that either cools or generates heat depending on voltage polarity, and a refrigerator controlled by this control method.

Another aspect of the present disclosure is to provide a method of controlling a refrigerator, that can control a refrigerator with a thermoelectric device by using different physical properties such as temperature and humidity measured by a sensor unit, and a refrigerator controlled by this control method.

Yet another aspect of the present disclosure is to provide a control method that can achieve sufficient cooling performance, power consumption reduction, and fan noise reduction based on sensed temperature, and a refrigerator controlled by this control method.

FIG. 1 is a conceptual diagram showing an example of a refrigerator 100 having a thermoelectric device module 170. The refrigerator 100 may be configured to function, for example, as a side table. The refrigerator may be configured as a piece of furniture such as an end table, coffee table, night end table, a kitchen table, or another appropriate piece of furniture in which a refrigerator is desirable. Merely for ease of discussion, the refrigerator will be described with reference to a side table. The side table may be configured such that a table lamp, etc. may be placed on top and small items may be stored inside. The refrigerator 100 may be configured to store food at low temperatures while functioning as a piece of furniture.

The exterior of the refrigerator 100 may be formed by a cabinet 110 and doors 130. The cabinet 119 may be formed by an inner casing 111, an outer casing 112, and an insulator 113. The inner case 111 may be mounted on the inside of the outer casing 112, and may form a storage compartment 120 for storing food at low temperatures. The refrigerator in this case may be limited in size so that the refrigerator 100 may be used as a side table, therefore, the storage compartment 120 formed by the inner casing 111 may also be limited in size, for example, about 200 L.

The outer casing 112 may form the exterior of the side table shape. Since the doors 130 may be mounted on the front of the refrigerator 100, the outer casing 112 may form the exterior of the refrigerator 100 except the front. The top surface of the outer casing 112 may be flat so that small items such as a lamp may be placed on it.

The insulator 113 may be disposed between the inner casing 111 and the outer casing 112. The insulator 113 is for inhibiting heat transfer from the outside, which is relatively hot, to the storage compartment 120 which is relatively cold.

The doors 130 may be fitted to the front of the cabinet 110. The doors 130, along with the cabinet 110, may form the exterior of the refrigerator 100. The doors 130 may be configured to open and close the storage compartment 120 or mounted on hinges to swing open. The refrigerator 100 may have two or more doors 131 and 132, and each door 130 may be disposed in an up-down direction, as illustrated in FIG. 1.

Drawers 140 for efficient use of space may be mounted to the storage compartment 120. The drawers 140 may form a food storage area within the storage compartment 120. The doors 130 may be slideable or may swing open. The drawers 140 may be attached to the doors 130, and may be pulled in and out from the storage compartment 120 together with the doors 130.

The two drawers 141 and 142 may be disposed vertically to correspond to the doors 130. The drawers 141 and 142 may be respectively attached to the doors 131 and 132, and the drawers 141 and 142 attached to the doors 131 and 132 may be pulled out from the storage compartment 120, along with the doors 131 and 132 as the doors 131 and 132 slide.

A mechanical compartment 150 may be formed behind the storage compartment 120. To form the mechanical compartment 150, the outer casing 112 may have a sidewall 112*a*. In this case, the insulator 113 is disposed between the sidewall 112*a* and the inner casing 111. The mechanical compartment 150 may be equipped with various types of electrical and mechanical equipment for running the refrigerator 100.

A support 160 may be mounted to the bottom of the cabinet 110. As shown in FIG. 1, the support 160 may be structured to raise the refrigerator 100 off of the floor. When installed in a bedroom or the like, the refrigerator 100 may be more accessible to or in closer proximity to the user than when the refrigerator 100 is installed in a kitchen. Thus, it is desirable that the refrigerator 100 be spaced apart from the floor to make it easy to clean up dust or other debris piled up between the refrigerator 100 and the floor. Since the support 160 allows the cabinet 110 to be spaced apart from the floor where the refrigerator 100 is to be installed, this structure makes cleaning easier.

Unlike other home electronic appliances, the refrigerator 100 may run 24 hours a day. For this reason, if the refrigerator 100 is placed beside a bed, noise and vibration from the refrigerator 100 may be transmitted to a person lying on the bed to disturb the person's sleep or otherwise cause inconvenience. Therefore, the refrigerator 100 should achieve low-noise and low-vibration performance in order that the refrigerator 100 suitable for placement beside a bed.

If a refrigeration cycle device including a compressor is used for cooling the storage compartment 120 of the refrigerator 100, it is difficult to block out noise and vibration generated by the compressor. Accordingly, the refrigeration cycle device should be used in a restricted way to achieve low-noise and low-vibration performance, and the refrigerator 100 may cool the storage compartment 120 using the thermoelectric device module 170.

The thermoelectric device module 170 may be mounted to a rear wall 111*a* of the storage compartment 120 to cool the storage compartment 120. The thermoelectric device module 170 includes a thermoelectric device. The thermoelectric device refers to a device that cools and generates heat using the Peltier effect, as previously described. By placing the heat absorption side of the thermoelectric device toward the storage compartment 120 and the heat generation side of the thermoelectric device toward the outside of the refrigerator 100, the storage compartment 120 may be cooled by running the thermoelectric device.

The controller 180 may be configured to control the overall operation of the refrigerator 100. For example, the controller 180 may control the output power of the thermoelectric device or fans equipped in the thermoelectric device module 170, and may also control the operations of different types of components equipped in the refrigerator 100. The controller 180 may include one or more printed circuit boards PCB and a microcomputer, and other appropriate IC's or processors based on the application. The controller 180 may be mounted in, but not necessarily limited to, the mechanical compartment 150.

When the controller 180 controls the thermoelectric device module 170, the output power of the thermoelectric device may be controlled based on the temperature of the storage compartment 120, a set temperature input by the user, the outside temperature (or exterior temperature) of the refrigerator 100, or another appropriate factor based on desired functions. The outside temperature may be an ambient or room temperature outside the storage compartment or outside the body of the refrigerator. Cooling operation, defrosting operation (or defrost operation), load handling operation (load response operation), etc. may be determined as controlled by the controller 180, and the output power of the thermoelectric device may depend on the operation determined by the controller 180.

The temperature of the storage compartment 120 or the outside temperature of the refrigerator may be measured by a sensor unit (or sensor) 191, 192, 193, 194, and 195 provided in the refrigerator. The sensor unit 191, 192, 193, 194, and 195 may include at least one device that measures physical properties, including temperature sensors 191, 192, and 193, a humidity sensor 194, a wind pressure sensor 195 or the like. For example, the temperature sensors 191, 192, and 193 may be mounted to the storage compartment 120, the thermoelectric device module 170, and the outer casing 112, respectively, and the temperature sensors 191, 192, and 193 may measure the temperature of the area where they are mounted.

The in-refrigerator temperature sensor 191 may be mounted to the storage compartment 120, and may be configured to measure the temperature of the storage compartment 120. The defrosting temperature sensor 192 (or defrost temperature sensor, defrost sensor) may be mounted to the thermoelectric device module 170, and may be configured to measure the temperature of the thermoelectric device module 170. The external air temperature sensor 193 may be mounted to the outer casing 112, and may be configured to measure the outside temperature of the refrigerator 100.

The humidity sensor 194 may be mounted to the storage compartment 120, and may be configured to measure the humidity of the storage compartment 120. The air pressure sensor 195 may be mounted to the thermoelectric device module 170, and may be configured to measure the air pressure of a first fan 173.

Figure 2:
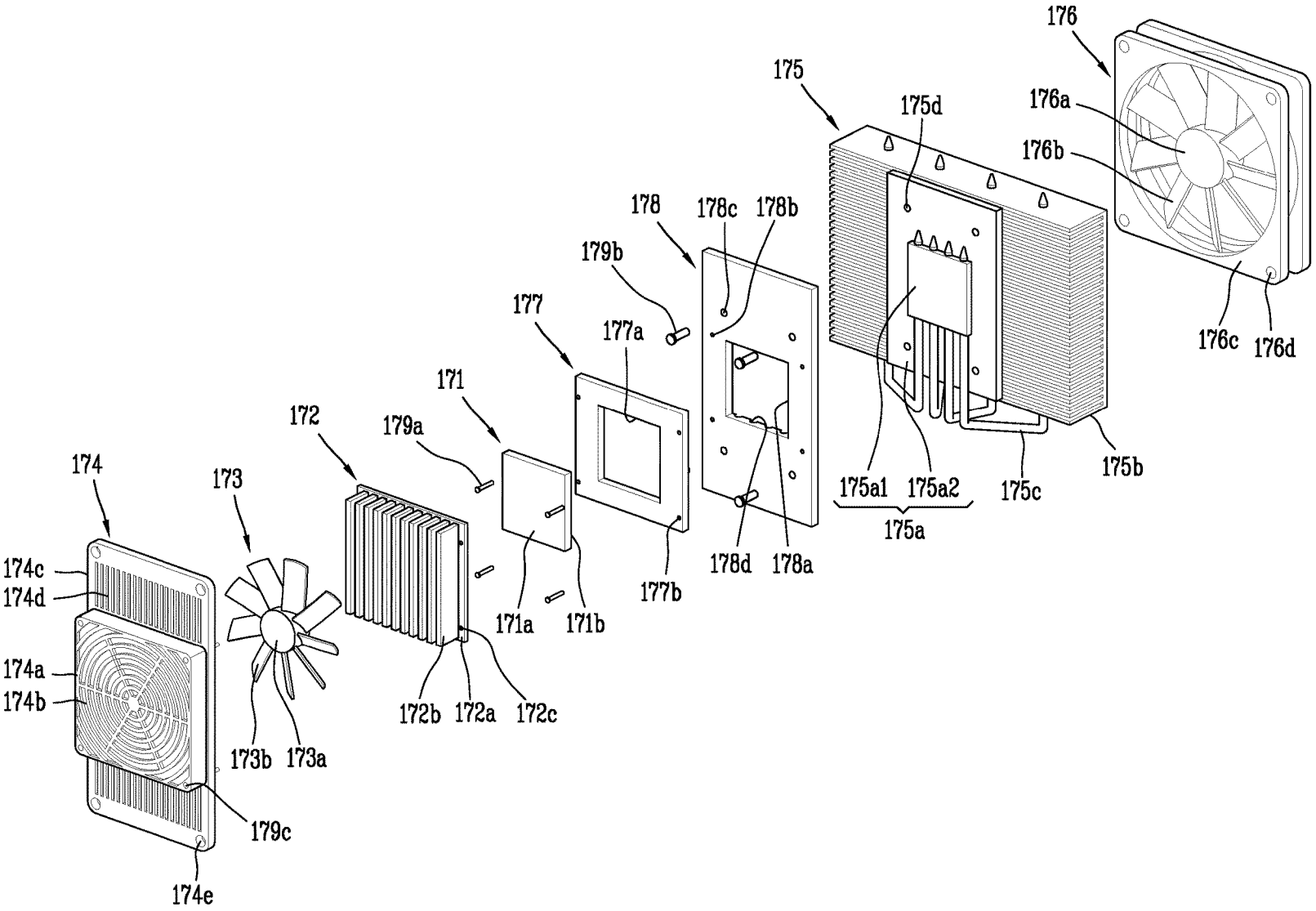
FIG. 2 is an exploded perspective view of the thermoelectric device module.

FIG. 2 is an exploded perspective view of the thermoelectric device module 170. Merely to facilitate description, the thermoelectric device module will be described herein with reference to the refrigerator 100 of FIG. 1, but it should be appreciated that the thermoelectric device module of the present disclosure may be applied to various types of devices.

The thermoelectric device module 170 may include a thermoelectric device 171, a first heat sink 172, the first fan 173, a second heat sink 175, a second fan 176, and an insulator 177. The thermoelectric device module 170 operates between first and second areas that are separate from each other, and is configured to absorb heat in one of the two areas and dissipates heat in the other area.

The first area and the second area refer to areas that are spatially separated from each other by a boundary. When the thermoelectric device module 170 is used in the refrigerator 100, the first area may correspond to either the storage compartment 120 or the outside of the refrigerator 100, and the second area may correspond to the other.

The thermoelectric device 171 may be formed by connecting a plurality of PN junctions in series, each of them consisting of a P-type semiconductor and an N-type semiconductor. The thermoelectric device 171 has a heat absorption part 171*a* and a heat dissipation part 1 Mh that work in opposite directions. For efficient heat transfer, it is desirable that the heat absorption part 171*a* and the heat radiation part 171*b* be shaped in such a way as to enable their surfaces to make contact with each other. Thus, the heat absorption part 171*a* may be called a heat absorption surface and the heat dissipation part 171*b* a heat dissipation surface. Also, the heat absorption part 171*a* and the heat dissipation part 171*b* may be generally called a first part and a second part, a first surface and a second surface or first side and a second side. This naming is used herein merely for illustration purposes and does not limit the scope of the disclosure.

The first heat sink 172 may make contact with the heat absorption part 171*a* of the thermoelectric device 171. The first heat sink 172 may undergo heat exchange with the first area. The first area may correspond to the storage compartment 120, and may undergo heat exchange with the air inside the storage compartment 120.

The first fan 173 may be mounted to face the first heat sink 172, and may blow air to facilitate the heat transfer of the first heat sink 172. Since heat transfer is a natural phenomenon, the first heat sink 172 can exchange heat with the air in the storage compartment 120 without the first fan 173. Still, the heat transfer of the first heat sink 172 may be facilitated even more since the thermoelectric device module 170 includes the first fan 173.

The first fan 173 may be covered with a cover 174. The cover 174 may include other parts, apart from a portion 174*a* (or grill, guard) surrounding the first fan 173. The part 174*a* covering the first fan 173 may have a plurality of holes 174*b* (or openings) to allow the air inside the storage compartment 120 to pass through the cover 174.

Moreover, the cover 174 may have a structure that can be fixed to the rear wall 111*a* of the storage compartment 120. In an example, FIG. 2 illustrates a structure in which the cover 174 has a portion 174*c* extending from both sides of the portion 174*a* surrounding the first fan 111 and screw fastening holes 174*e* for inserting screws are formed in the extending portion 174*c*. Further, screws 179*c* may be inserted into the portion surrounding the first fan 173 and further fix the cover 174 to the rear wall 111*a*. Holes 174*b* and 174*d* may be formed in the portion 174*a* surrounding the first fan 173 and the extending portion 174, respectively, to allow air to pass through.

The second heat sink 175 may be disposed to make contact with the heat radiation part 171*b* (or heat dissipation part) of the thermoelectric device 171. The second heat sink 175 may be configured to exchange heat with the second area. The second area corresponds to a space outside the refrigerator 100, and the second heat sink 175 may undergo heat exchange with the air outside the refrigerator 100.

The second fan 176 may be mounted to face the second heat sink 175, and may blow air to facilitate heat transfer of the second heat sink 175. The second fan 176 may facilitate the heat transfer of the second heat sink 175 in the same way as the first fan 173 facilitates the heat transfer of the first heat sink 172.

The second fan 176 may optionally have a shroud 176*c*. The shroud 176*c* is for guiding air. For example, as shown in FIG. 2, the shroud 176 may be configured to surround vanes 176*b* where it is spaced apart from the vanes 176*c*. Additionally, screw fastening holes 176*d* for fixing the second fan 176 may be formed in the shroud 176*c*.

The first heat sink 172 and the first fan 173 may correspond to the heat absorption side of the thermoelectric device module 170. The second heat sink 175 and the second fan 176 may correspond to the heat generation side of the thermoelectric device module 170.

At least one of the first and second heat sinks 172 and 175 may include a base 172*a* or 175*a* and fins 172*b* or 175*b*. It should be noted that the following non-limiting description will be given on the assumption that both the first heat sink 172 and the second heat sink 175 include bases 172*a* and 175*a* and fins 172*b* and 175*b*, respectively but is not limited thereto.

The bases 172*a* and 175*a* may be configured to make surface contact with the thermoelectric device 171. The base 172*a* of the first heat sink 172 makes surface contact with the heat absorption part 171*a* of the thermoelectric device 171, and the base 175*a* of the second heat sink 175 makes surface contact with the heat dissipation part 171*b* of the thermoelectric device 171.

Ideally, the bases 172*a* and 175*a* and the thermoelectric device 171 make surface contact with each other, since thermal conductivity increases with increasing heat transfer surface area. Moreover, a thermal conductor (thermal grease, thermal compound or the like) may be used to increase thermal conductivity by filling tiny gaps between the bases 172*a* and 175*a* and the thermoelectric device 171.

The fins 172*b* and 175*b* protrude from the bases 172*a* and 175*b* so as to exchange heat with the air in the first area or the air in the second area. The first area may correspond to the storage compartment 120, and the second area may correspond to the outside of the refrigerator 100. Thus, the fins 172*b* of the first heat sink 172 may be configured to undergo heat exchange with the air in the storage compartment 120, and the fins 175*b* of the second heat sink 175 may be configured to undergo heat exchange with the air outside the refrigerator 100.

The fins 172*b* and 175*b* may be spaced at prescribed intervals, because the heat transfer surface area is increased by spacing the fins 172*b* and 175*b* at intervals. There may be reduced or no heat transfer at surfaces between the fins 172*b* and 175*b* if the fins 172*b* and 175*b* are placed close to one another, whereas there may be improved heat transfer at surfaces between the fins 172*b* and 175*b* if the fins 172*b* and 175 are spaced at intervals. Since thermal conductivity increases with increasing heat transfer surface area, the surface area of the fins exposed to the first area and second area should be increased to improve the heat transfer performance of the heat sinks.

Moreover, the thermal conductivity of the second heat sink 175 corresponding to the heat generation side should be greater than that of the first heat sink 172, in order for the first heat sink 172 corresponding to the heat absorption side to provide sufficient cooling. This is because quicker heat dissipation by the heat dissipation part 171*b* of the thermoelectric device 171 allows more heat absorption by the heat absorption part 171*a*. This accounts for the fact that the thermoelectric device 171 is not merely a thermal conductor but a device that, when a voltage is applied, absorbs heat at one side and dissipates heat at the other side. Therefore, the heat dissipation part 171*b* of the thermoelectric device 171 should provide more heat dissipation to ensure sufficient cooling by the heat absorption part 171*a*.

In view of this, when the first heat sink 172 absorbs heat and the second heat sink 175 dissipates heat, the heat transfer surface area of the second heat sink 175 should be larger than the heat transfer surface area of the first heat sink 172. Assuming that the entire heat transfer surface area of the first heat sink 172 is used for heat transfer, the heat transfer surface area of the second heat sink 175 may be, for example, three times as large as the heat transfer surface area of the first heat sink 172.

The same principle applies to the first fan 173 and the second fan 176. In order that the heat absorption side provide sufficient cooling, the air volume and air velocity of the second fan 176 may be greater than the air volume and air velocity of the first fan 173.

Since the second heat sink 175 requires a larger heat transfer surface area than the first heat sink 172, the base 175*a* and the fins 175*b* may have a larger surface area than the base 172*a* and the fin 172*b* of the first heat sink 172. Further, the second heat sink 175 may have a heat pipe 175*c* to rapidly distribute the heat transferred to the base 175*a* of the second heat sink 175 across the fins.

The heat pipe 175*c* may be configured to contain a heat transfer fluid, and one end of the heat pipe 175*c* may be inserted in the base 175*c* and the other end may be inserted through the fins 175*b*. The heat pipe 175*c* is a device that transfers heat from the base 175*a* to the fins 175*b* by the evaporation of the heat transfer fluid contained in it. Without the heat pipe 175*c*, heat transfer will only occur at some of the fins 175*b* close to the base 175*c*. This is because heat may not sufficiently be distributed across the fins 175*b* that are farther from the base 175*a*.

However, the heat pipe 175 enables heat transfer across all the fins 175*b* of the second heat sink 175. This is because heat from the base 175*a* can be distributed uniformly across the fins 175, even as far as those at distal ends from the base 175*a*.

The base 175*a* of the second heat sink 175 may be formed of two layers 175*a*1 and 175*a*2 to contain the heat pipe 175*c*. The base 175*a* may be configured such that the first layer 175*a*1 surrounds one side of the heat pipe 175 and the second layer 175*a*2 surrounds the other side of the heat pipe 175*c*, the two layers 175*a*1 and 175*a*2 facing each other.

The first layer 175*a*1 may be disposed to make contact with the heat radiation part 171*b* of the thermoelectric device 171, and may be equal or similar in size to thermoelectric device 171. The second layer 175*a*2 may be connected to the fins 175*b*, and the fins 175*b* may protrude from the second layer 175*a*2. The second layer 175*a*2 may be greater in size than the first layer 175*a*1. One end of the heat pipe 175*c* may be disposed between the first layer 175*a*1 and the second layer 175*a*2 to run.

The insulator 177 may be mounted between the first heat sink 172 and the second heat sink 175. The insulator 177 may be formed in such a way as to surround the edge of the thermoelectric device 171. For example, as shown in FIG. 2, a hole 177*a* may be formed in the insulator 177, and the thermoelectric device 171 may be placed in the hole 177*a*. Here, the outer side surfaces of the thermoelectric device 171 may contact the inner side surfaces of the hole 177*a*.

As explained above, the thermoelectric device module 170 is not merely a thermal conductor but a device that cools the storage compartment 120 by absorbing heat on one side of the thermoelectric device 171 and dissipating heat on the other side. Thus, it may not be desirable to directly transfer heat from the first heat sink 172 to the second heat sink 175. This is because a decrease in temperature difference between the first heat sink 172 and the second heat sink 175 due to direct heat transfer can degrade the performance of the thermoelectric device 171. To prevent this phenomenon, the insulator 177 may be configured to avoid direct heat transfer between the first heat sink 172 and the second heat sink 175.

A fastener plate 178 may be disposed between the first heat sink 172 and the insulator 177 or between the second heat sink 175 and the insulator 177. The fastener plate 178 may be provided to mount the first heat sink 172 and the second heat sink 175. The first heat sink 172 and the second heat sink 175 may be screwed to the fastener plate 178 with screws.

Along with the insulator 177, the fastener plate 178 may be configured to surround the edge of the thermoelectric device 171. The fastener plate 178 may have a hole 178*a* corresponding to the thermoelectric device 171, like the insulator 177, and the thermoelectric device 171 may be placed in the hole 178*a*. However, the fastening plate 178 is not an essential component of the thermoelectric device module 170 and may be replaced by other components that can fix the first heat sink 172 and the second heat sink 175.

A plurality of screw fastening holes 178*b* and 178*c* for fixing the first heat sink 172 and the second heat sink 175 may be formed in the fastening plate 178. Screw fastening holes 172*c* and 177*b* corresponding the fastening plate 178 may be formed in the first heat sink 172 and the insulator 177, and screws 179*a* may be sequentially inserted into the screw fastening holes 172*c*, 177*b*, and 178*b* to fix the first heat sink 172 to the fastener plate 178. Screw fastening holes 175*d* corresponding to the fastener plate 178 may be formed in the second heat sink 175 as well, and screws 179*b* may be sequentially inserted into the screw fastening holes 178*c* and 175*d* to fix the second heat sink 175 to the fastener plate 178.

A recessed portion 178*d* for receiving one side of the heat pipe 175*c* may be formed in the fastener plate 178. The recessed portion 178*d* may be configured to correspond to the heat pipe 175*c* and partially surround it. Even if the second heat sink 175 has a heat pipe 175*c*, the second heat sink 175 may be firmly attached to the fastener plate 178 since the fastener plate 178 has the recessed portion 178*d*, thereby making the thermoelectric device module 170 thinner overall.

At least one of the aforementioned first and second fans 173 and 176 may have a hub 173*a* or 176*a* and vanes 173*b* or 176*b*. The hubs 173*a* and 176*a* may be attached to a central rotating shaft. The vanes 173*b* and 176*b* may be radially mounted around the hubs 173*a* and 176*a*.

The first fan 173 and the second fan 176 may be configured as axial flow fans 173 and 176. The axial flow fans 173 and 176 are different than a centrifugal fan. The axial flow fans 173 and 1776 may be configured to blow air in the direction of the axis of rotation, and air flows in the direction of the axis of rotation of the axial flow fans 173 and 176 and flows out in the direction of the axis of rotation. On the contrary, the centrifugal fan is configured to blow air in a centrifugal direction (or circumferential direction), and air flows in the direction of the axis of rotation of the centrifugal fan and flows out in the centrifugal direction. The first fan 173 is disposed to face the first heat sink 172, and the second fan 176 is disposed to face the second heat sink 175, and therefore it is desirable that the first and second fans 173 and 176 are configured as axial flow fans 173 and 176 which blow air in an axial direction.

Hereinafter, a method of controlling a refrigerator with the thermoelectric device module 170 that can provide high cooling performance and reduce power consumption and fan noise will be described.

Figure 3:
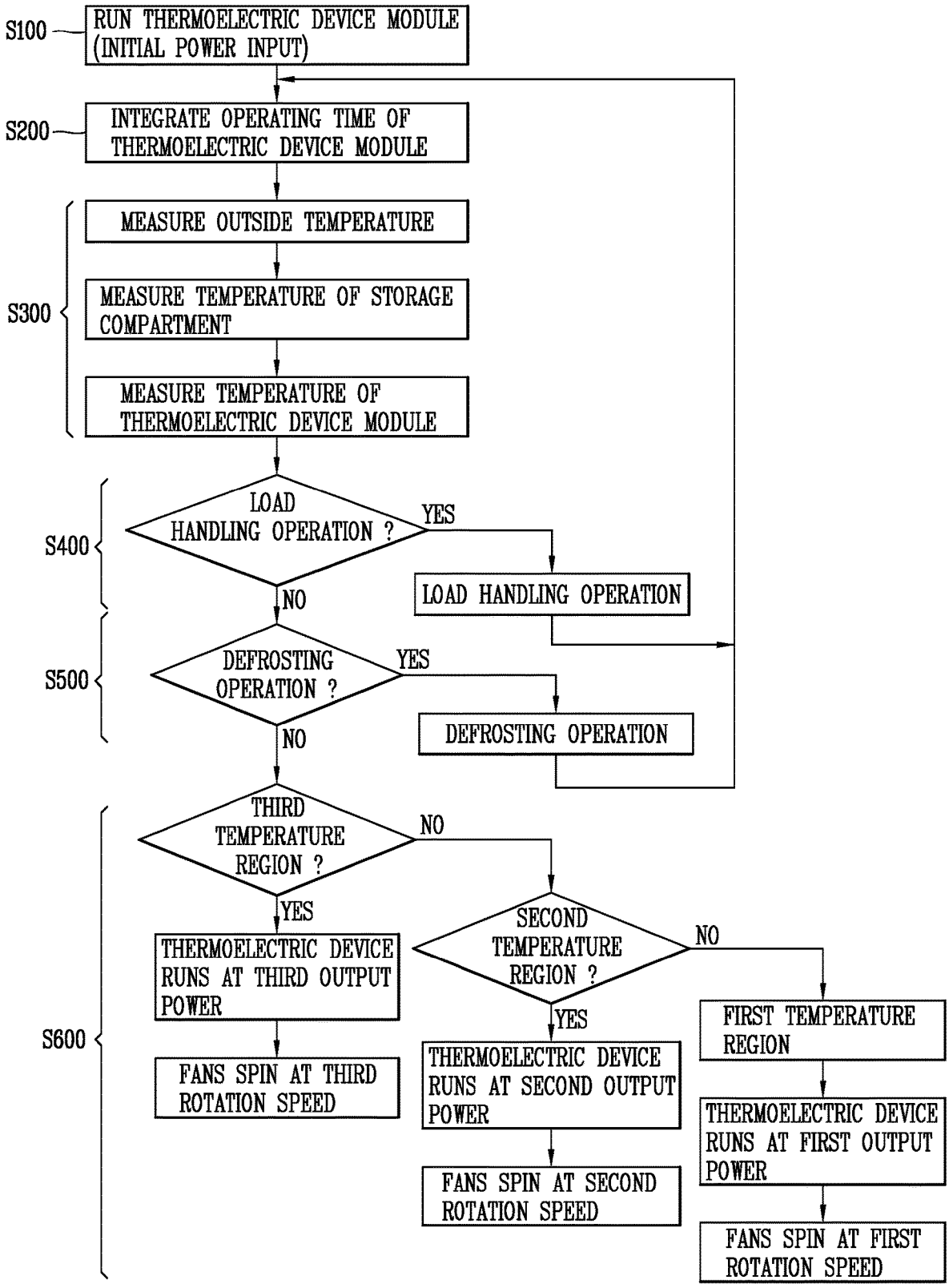
FIG. 3 is a flowchart of a method of controlling a refrigerator proposed in the present invention.

FIG. 3 is a flowchart of a method of controlling a refrigerator. First, the thermoelectric device module may start a cooling operation when powered for initial power input or other reasons (S100). Since the power to the thermoelectric device module may be cut off for natural defrosting (self-defrosting) or other reasons, the thermoelectric device modules may resume the cooling operation when power is input again into the thermoelectric device module after completion of the natural defrosting process.

Next, the operating time of the thermoelectric device module is integrated (S200). The integration includes accumulatively counting the operating time of the thermoelectric device module. The integration of the operating time of the thermoelectric device modules may continue throughout the process of controlling the refrigerator, which accounts for why the defrosting operation is performed.

Next, the outside temperature of the refrigerator, the temperature of the storage compartment, and the temperature of the thermoelectric device module are measured (S300). Along with a set temperature input by the user, the temperatures measured in this step may be used for the controller to control the output power of the thermoelectric device or the output power of the fans.

It is determined whether a load handling operation is required (S400). If it is determined that a load handling operation is required, the load handling operation is started in such a way that the thermoelectric device runs at a preset output power and the fans rotate at a preset rotation speed. If it is determined that no load handling operation is required, the process proceeds to the next step.

It is determined whether a defrosting operation is required (S500). Once it is determined a defrosting operation is required, the defrosting operation is started in such a way that the thermoelectric device runs at a preset output power and the fans rotate at a preset rotation speed. In the case of natural defrosting, however, the power supplied to the thermoelectric device may be turned off. If it is determined that no defrosting operation is required, the process proceeds to the next step.

The load handling operation and the defrosting operation may be performed prior to a cooling operation (S600). Thus, if it is determined that no load handling operation and no defrosting operation are required, the cooling operation may be performed. The cooling operation may be controlled based on the temperature of the storage compartment and the temperature input by the user. The control results may be presented as the thermoelectric device's output power and the fans' output.

The output power of the thermoelectric device may be determined based on the temperature of the storage compartment, the set temperature input by the user, and the outside temperature of the refrigerator. Also, the rotation speed of the fans may be determined based on the temperature of the storage compartment. Here, the fans refer to at least one of the first or second fans of the thermoelectric device module.

For example, operation of the thermoelectric device and the fans may be controlled differently based multiple temperature ranges. If the temperature of the storage compartment in the flowchart of FIG. 3 corresponds to a third temperature region, the thermoelectric device runs at a third output power and the fans spin at a third rotation speed. If the temperature of the storage compartment corresponds to a second temperature region, the thermoelectric device runs at a second output power and the fans spin at a second rotation speed. If the temperature of the storage compartment corresponds to a first temperature region, the thermoelectric device runs at a first output power and the fans spin at a first rotation speed.

Hereinafter, the control of the thermoelectric device and fans for each temperature region will be described with reference to FIG. 4 and Tables 1 and 2. It should be appreciated that the numerical values in the drawing and tables are non-limiting and are provided merely as examples to facilitate explanation of the concept of this disclosure, and do not constitute absolute values necessarily required for the control method of the present disclosure.

Figure 4:
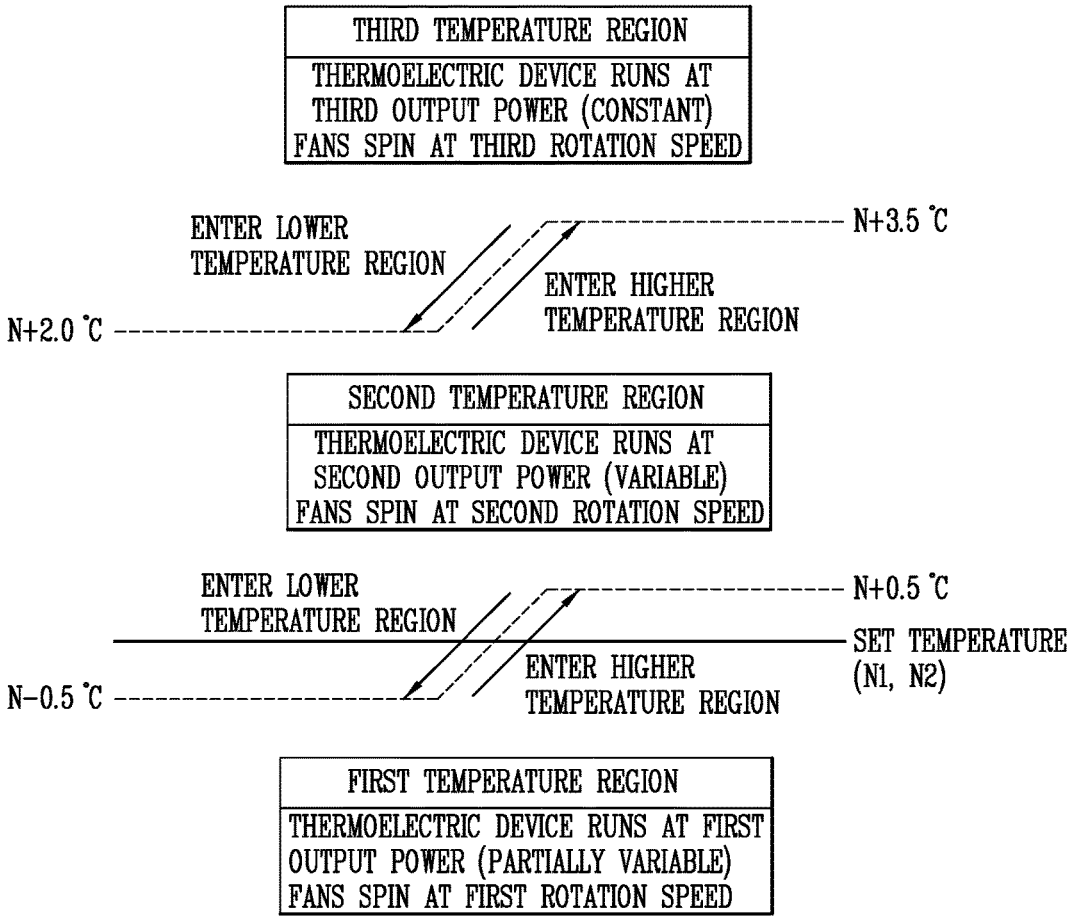
FIG. 4 is a conceptual diagram explaining a method of controlling a refrigerator based on which of first to third temperature regions the temperature of a storage compartment falls within.

FIG. 4 is a conceptual diagram explaining a method of controlling a refrigerator based on one of first to third temperature regions that corresponds to the temperature of a storage compartment.

The temperature ranges for the storage compartment may be divided into a first temperature region, a second temperature region, and a third temperature region. The first, the second, and the third temperature regions (or temperature ranges) may be ranges in temperature relative to a set temperature. For example, when the set temperature is 3° C. (or 37° F.), the first temperature region may be at lower temperatures than when the set temperature is 8° C. (or 46° F.). Here, the size of the range may be the same or different.

Here, the first temperature region may be a range that includes the set temperature input by the user. The second temperature region may be a temperature region higher than the first temperature region. The third temperature region may be a temperature region higher than the second temperature region. As such, the temperature increases sequentially from the first temperature region to the third temperature region.

Since the first temperature region includes the set temperature input by the user, if the temperature of the storage compartment is within the first temperature region, the temperature of the storage compartment has already reached the set temperature due to the operation of the thermoelectric device module. Therefore, the first temperature region is a range in which the set temperature has been met.

The second temperature region and the third temperature region are ranges higher than the set temperature input by the user, and are therefore may be referred to as unsatisfactory ranges in which the set temperature has not been met. Thus, in the second and third temperature regions, operation of the thermoelectric device module is required to lower the temperature of the storage compartment to the set temperature. The third temperature region may require much stronger cooling since it is at higher temperatures than the second temperature region. The second temperature region and the third temperature region may also be referred to as an unsatisfactory range and an upper limit range, respectively, to distinguish them from each other.

The boundary of each temperature region depends on whether the temperature of the storage compartment enters a higher or lower temperature region, and the temperature to enter a higher region may be different than a temperature to enter a lower region. This range in temperature points to enter different regions may be referred to as a maintenance band. For example, referring to FIG. 4, a point at which the temperature of the storage compartment enters the second temperature region from the first temperature region may be N+0.5° C. In contrast, a point at which the temperature of the storage compartment enters the second temperature region from the first temperature region may be N−0.5° C. Accordingly, a point at which the temperature of the storage compartment enters a higher temperature region is higher than a point at which the temperature of the storage compartment enters a lower temperature region.

The point N+0.5° C. at which the temperature of the storage compartment enters the second temperature region from the first temperature region may be higher than the set temperature N input by the user. In contrast, the point N−0.5° C. at which the temperature of the storage compartment enters the first temperature region from the second temperature region may be lower than the set temperature N input by the user.

Likewise, referring to FIG. 4, a point at which the temperature of the storage compartment enters the third temperature region from the second temperature region may be N+3.5° C. In contrast, a point at which the temperature of the storage compartment enters the second temperature region from the second temperature region may be N+2.0° C. Accordingly, a point at which the temperature of the storage compartment enters a higher temperature region is higher than a point at which the temperature of the storage compartment enters a lower temperature region.

If a point at which the temperature of the storage compartment enters a higher temperature region and a point at which the temperature of the storage compartment enters a lower temperature region are equal, the storage compartment may not be sufficiently cooled and the control of the thermoelectric device or fans is changed. For example, if the set temperature is reached as soon as the temperature of the storage compartment enters the first temperature region from the second temperature region, and therefore the thermoelectric device and the fans stop running, the temperature of the storage compartment immediately enters the second temperature region. To prevent this and sufficiently maintain the temperature of the storage compartment in the first temperature region, a maintenance band may be provided where a point at which the temperature of the storage compartment enters the lower temperature must be lower than a point at which the temperature of the storage compartment enters the higher temperature region. A size of the maintenance band may be adjusted based on temperature in the storage compartment, outside temperature, a desired level of responsiveness of the system, or the like based on the application and installation of the refrigerator. Moreover, the maintenance band for higher temperature regions (e.g., 1.5° C.) may be greater than that of the lower maintenance band (e.g., 1.0° C.). The maintenance band may prevent excessive wear and tear of components as well as excessive changes in modes of operation.

Here, the output power of the thermoelectric device and the rotation speed of the fans relative to a certain set temperature will be described first. Then, changes in control relative to a set temperature will be described.

The thermoelectric device's output power relative to a certain set temperature N1 is shown in Table 1. If a side of the thermoelectric device in contact with the first heat sink corresponds to a heat absorption side, the Hot/Cool section of Table 1 is marked as Cool, and if this side corresponds to a heat dissipation side, the Hot/Cool section of Table 1 is marked as Hot. Also, RT refers to the outside temperature (or room temperature) of the refrigerator.

TABLE 1

| No. | Condition (first set temperature N1) | Hot/ Cool | RT < 12° C. | RT > 12° C. | RT > 18° C. | RT > 27° C. |
|---|---|---|---|---|---|---|
| 1 | Third temperature region | Cool | +22 V | +22 V | +22 V | +22 V |
| 2 | Second temperature region | Cool | +12 V | +14 V | +16 V | +22 V |
| 3 | First temperature region | Cool | 0 V | 0 V | +12 V | +16 V |

The output power of the thermoelectric device is determined based on whether the temperature of the storage compartment is within the first, second, or third temperature regions.

The thermoelectric device's output power may be derived from the voltage applied to the thermoelectric device since the thermoelectric device's output power increases as the voltage applied to the thermoelectric device becomes higher. An increase in the thermoelectric device's output power allows the thermoelectric device to achieve stronger cooling.

Meanwhile, the rotation speed of the fans is determined based on whether the temperature of the storage compartment falls within the first, second, or third temperature regions. Here, the fans refer to the first and/or second fan of the thermoelectric device module.

The rotation speed of the fans may be represented in the number of rotations of the fans per unit of time or RPM. A fan running at a higher RPM means that the fan spins faster. When a higher voltage is applied to the fan, the number of rotations of the fan is increased. With the fan spinning faster, the heat transfer of the first heat sink and/or second heat sink is enhanced, thereby achieving stronger cooling.

Referring to FIG. 4, if the temperature of the storage compartment falls within the third temperature region, the thermoelectric device runs at the third output power. In Table 1, the third output power may be +22V regardless of the outside temperature. The third output power may be a constant value regardless of the outside temperature.

The third output power (+22V) may be a value that exceeds the first output power (e.g., 0V, +12V, and +16V in Table 1) in the first temperature region. Also, the third output power may be a value equal to or higher than the second output power (e.g., +12V, +14V, +16V, and +22V in Table 1) in the second temperature region.

The third output power may correspond to the highest output power of the thermoelectric device. In this case, the output power of the thermoelectric device in the third temperature region may remain constant at the highest output power.

Moreover, if the temperature of the storage compartment falls within the third temperature region, the fan spins at the third rotation speed. Here, the third rotation speed is a value exceeding the first rotation speed in the first temperature region. Also, the third rotation speed is a value equal to or higher than the second rotation speed in the second temperature region.

If the temperature of the storage compartment falls within the second temperature region, the thermoelectric device runs at the second output power. Here, the second output power is not a constant value but may be a value that gradually varies (increases) as the outside temperature measured by the external air temperature sensor increases. In Table 1, the second output power gradually increases to +12V, +14V, +16V, and +22V with increasing outside temperature.

Under the same outside temperature condition, the second output power is a value higher than the first output power in the first temperature region. Referring to Table 1, under the condition RT<12° C., the second output power may be +12V, higher than the first output power 0V. Under the condition RT>12° C., the second output power may be +14V, higher than the first output power 0V. Under the condition RT>18° C., the second output power may be +16V, higher than the first output power +12V. Under the condition RT>27° C., the second output power may be +22V, higher than the first output power +16V.

The second output power is a value lower than the third output power in the third temperature region. Referring to Table. 1, under every outside temperature condition, the second output power +12V, +14V, +16V, and +22V is equal to or lower than the third output power +22V.

Meanwhile, if the temperature of the storage compartment falls within the second temperature region, the fan spins at the second rotation speed. Here, the second rotation speed is a value equal to or higher than the first rotation speed in the first temperature region. Also, the second rotation speed is a value equal to or lower than the third rotation speed in the third temperature region.

If the temperature of the storage compartment falls within the first temperature region, the thermoelectric device runs at the first output power. Here, the first output power is not a constant value but may be a value that gradually varies (increases) as the outside temperature measured by the external air temperature sensor increases. Notably, in the first temperature region, when the outside temperature is higher than a reference outside temperature, the second output power gradually increases to 0V, +12V, and +16V with increasing outside temperature. However, in the first temperature region, when the outside temperature is equal to or lower than the reference outside temperature, the first output power is maintained at 0. That is, the thermoelectric device is kept in a stopped state. In Table 1, the reference outside temperature may be a value between 12° C. and 18° C.—for example, 15° C.

When comparing the first and second temperature regions in Table 1, the number of gradual increases in the second output power is higher than the number of gradual increases in the first output power in the same temperature range. The second output power changes in four stages: +12V, +14V, +16V, and +22V, whereas the first output power changes in three stages: 0V, +12V, and +16V in the same temperature range. Accordingly, the second temperature region corresponds to the entire variation region, and the first temperature region corresponds to a partial variation region.

Under the same outside temperature condition, the first output power may be a value lower than the second output power in the second temperature region. Referring again to Table 1, under the condition RT<12° C., the first output power 0V is lower than the second output power +12V. Under the condition RT>12° C., the first output power 0V is lower than the second output power +14V. Under the condition RT>18° C., the first output power +12V is lower than the second output power +16V. Under the condition RT>27° C., the first output power +16V is lower than the second output power +22V.

The first output power is a value lower than the third output power in the third temperature region. Referring again to Table 1, under every outside temperature condition, the first output power 0V, 0V, +12V, and +16V is lower than the third output power +22V.

The first output power includes 0 (e.g., 0V or 0 W). The output power 0 means that no voltage is applied to the thermoelectric device and the thermoelectric device is in a stopped state. That is, if the temperature of the storage compartment drops to a set temperature input by the user, the thermoelectric device may stop running.

Meanwhile, if the temperature of the storage compartment falls within the first temperature region, the fan spins at the first rotation speed. Here, the first rotation speed is a value equal to or lower than the second rotation speed in the second temperature region. Also, the first rotation speed is a value lower than the third rotation speed in the third temperature region.

The first rotation speed of the fan is higher than 0 (e.g., 0 RPM), which is different from the first output power of the thermoelectric device which includes 0. That is, this means that the fan is able to keep running when no voltage is applied to the thermoelectric device.

For example, under the condition RT<12° C., if the temperature of the storage compartment drops and enters the first temperature region from the second temperature region, no voltage may be applied to the thermoelectric device (e.g., when the first output power is 0V at RT<12° C. in Table 1). However, even when the temperature of the storage compartment enters the first temperature region from the second temperature region, the fan may keep spinning but at a lower rotation speed.

This is because the thermoelectric device remains cool for a considerable period of time even after it stops running, rather than being immediately brought to the ambient temperature. Thus, if the fan keeps spinning, this helps to continuously facilitate the heat transfer of the first heat sink and sufficiently maintain the temperature of the storage compartment in the first temperature region.

In conventional refrigerators, the temperature range of the storage compartment is divided into two stages: satisfactory and unsatisfactory, and the refrigeration cycle device runs only in the unsatisfactory region to lower the temperature of the storage compartment to a set temperature. Particularly, in the case of a refrigerator with a refrigeration cycle device, the temperature of the storage compartment cannot be divided and controlled in three stages. This is because turning the compressor on and off too often adversely affects the mechanical reliability of the compressor. The loss in mechanical reliability may be more detrimental than any benefits of operation in multiple the temperature ranges.

On the contrary, in a refrigerator with a thermoelectric device module, the temperature of the storage compartment may be divided into three stages for more detailed control, as in the control method proposed in the present disclosure. The thermoelectric device module only turns on and off electrically when a voltage is applied, which is not related to mechanical reliability and does not lead to degradation in reliability even if the thermoelectric device module is more frequently turned on and off.

Particularly, the cooling performance of the thermoelectric device module may be far below that of a refrigeration cycle device with a compressor. Thus, if the temperature of the storage compartment rises and enters the unsatisfactory region due to initial power input, the thermoelectric device being in a stopped state, application of a load such as food into the storage compartment, and other reasons, it takes a long time for the temperature of the storage compartment to rise and return to the satisfactory region. Accordingly, by defining the temperature of the storage compartment in three stages, apart from satisfactory and unsatisfactory, the temperature of the storage compartment can be quickly lowered from the third temperature region for the highest temperature at the highest output power.

Moreover, the first temperature region and the second temperature region are for reducing power consumption and fan noise, as well as for cooling. The refrigerator of the present disclosure can reduce power consumption and fan noise at the same time by segmenting the temperature range of the storage compartment and lowering the output power of the thermoelectric device and the rotation speed of the fans as the temperature of the storage compartment decreases.

Figure 5:
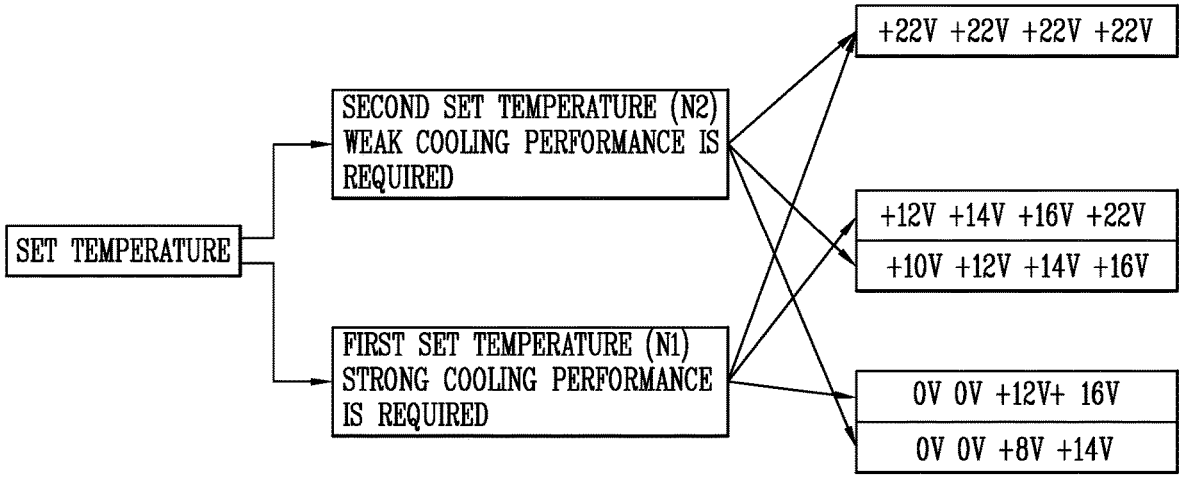
FIG. 5 is a conceptual diagram explaining a method of controlling a refrigerator based on whether a set temperature input by a user corresponds to a first set temperature or a second set temperature.

Next, changes in control relative to a set temperature will be described. The output power of the thermoelectric device may be determined based on whether the temperature of the storage compartment corresponds to the first or second set temperatures. Changes in control relative to a set temperature is described by comparing the above-explained Table 1 and the following Table 2. FIG. 5 is a conceptual diagram explaining a method of controlling a refrigerator based on whether a set temperature input by a user corresponds to the first or second set temperatures.

TABLE 2

| No. | Condition (second set temperature N2) | Hot/ Cool | RT < 12° C. | RT > 12° C. | RT > 18° C. | RT > 27° C. |
|---|---|---|---|---|---|---|
| 1 | Third temperature region | Cool | +22 V | +22 V | +22 V | +22 V |
| 2 | Second temperature region | Cool | +10 V | +12 V | +14 V | +16 V |
| 3 | First temperature region | Cool | 0 V | 0 V | +8 V | +14 V |

Like Table 1, Table 2 shows the output power of the thermoelectric device for each temperature region of the storage compartment. The output power for each temperature region differs based on the outside temperature of the refrigerator. Tables 1 and 2 are distinguished by the set temperature input by the user.

Table 1 shows the results obtained when the set temperature input by the user corresponds to a first set temperature N1 lower than the reference set temperature. Table 2 shows the results obtained when the set temperature input by the user corresponds to a second set temperature N2 higher than the reference set temperature. For example, if the reference set temperature is 5° C., N1 is 3° C. and N2 is 8° C. Accordingly, it can be said that the first set temperature N1 requires stronger cooling than the second set temperature N2.

By comparing the first temperature region of Table 1 and the first temperature region of Table 2 and comparing the second temperature region of Table 2 and the second temperature region of Table 2, it can be seen that the output power of the thermoelectric device in Table 1, applied when stronger cooling is required, is higher. The areas in Tables 1 and 2 to be compared with each are shaded.

When comparing the shaded areas with each other, the first output power and the second output power differ from each other based on which of the first and second set temperatures N1 and N2 the set temperature corresponds.

Referring to the first temperature region, under the same outside temperature condition, the first output power +12V and +16V applied when the set temperature input by the user corresponds to the first set temperature N1 is higher than the first output power +8V and +14V corresponding to the second set temperature N2.

In the first temperature region, however, when the outside temperature is equal to or lower than the reference outside temperature (e.g, 15° C.), the first output power is constant at 0V regardless of whether the set temperature is the first or second set temperatures N1 and N2. This is because additional operation of the thermoelectric device may not be required since the temperature of the storage compartment may already meets the set temperature.

Likewise, for the second temperature region under the same outside temperature condition, the second output power +12V, +14V, +16V, and +22V corresponding to the first set temperature N1 is higher than the second output power +10V, +12V, +14V, and +16V corresponding to the second set temperature N2. The reason why the output power of the thermoelectric device differs with the set temperature input by the user is because the required cooling performance differs depending on each set temperature.

On the other hand, the third output power may be constant at +22V regardless of whether the input set temperature corresponds to the first or second set temperatures N1 and N2. This is because, in the third temperature region, the temperature of the storage compartment should be lowered as quickly as possible regardless of the set temperature input by the user.

Moreover, when the refrigerator is shipped to a retailer from the manufacturer, the second set temperature N2 may be used as default. For example, the refrigerator may be powered on and off repeatedly until the refrigerator is delivered to and used by the consumer. Repeated maximum or strong cooling with each power on or off results in unnecessary waste of power. In this manner, use of the second set temperature N2 may reduce power consumption until actual use by the consumer.

Hereinafter, the method of defrosting of the present disclosure will be described. The extended concept of defrosting proposed in the present disclosure is to achieve quick defrosting and reduction in power consumption by using heat source defrosting and natural defrosting in combination according to conditions. The heat source defrosting refers to defrosting the thermoelectric device module by supplying energy, and the natural defrosting refers to waiting for the thermoelectric device to defrost naturally without supplying energy. In natural defrosting, the heat source is the heat from the second heat sink.

Figure 6:
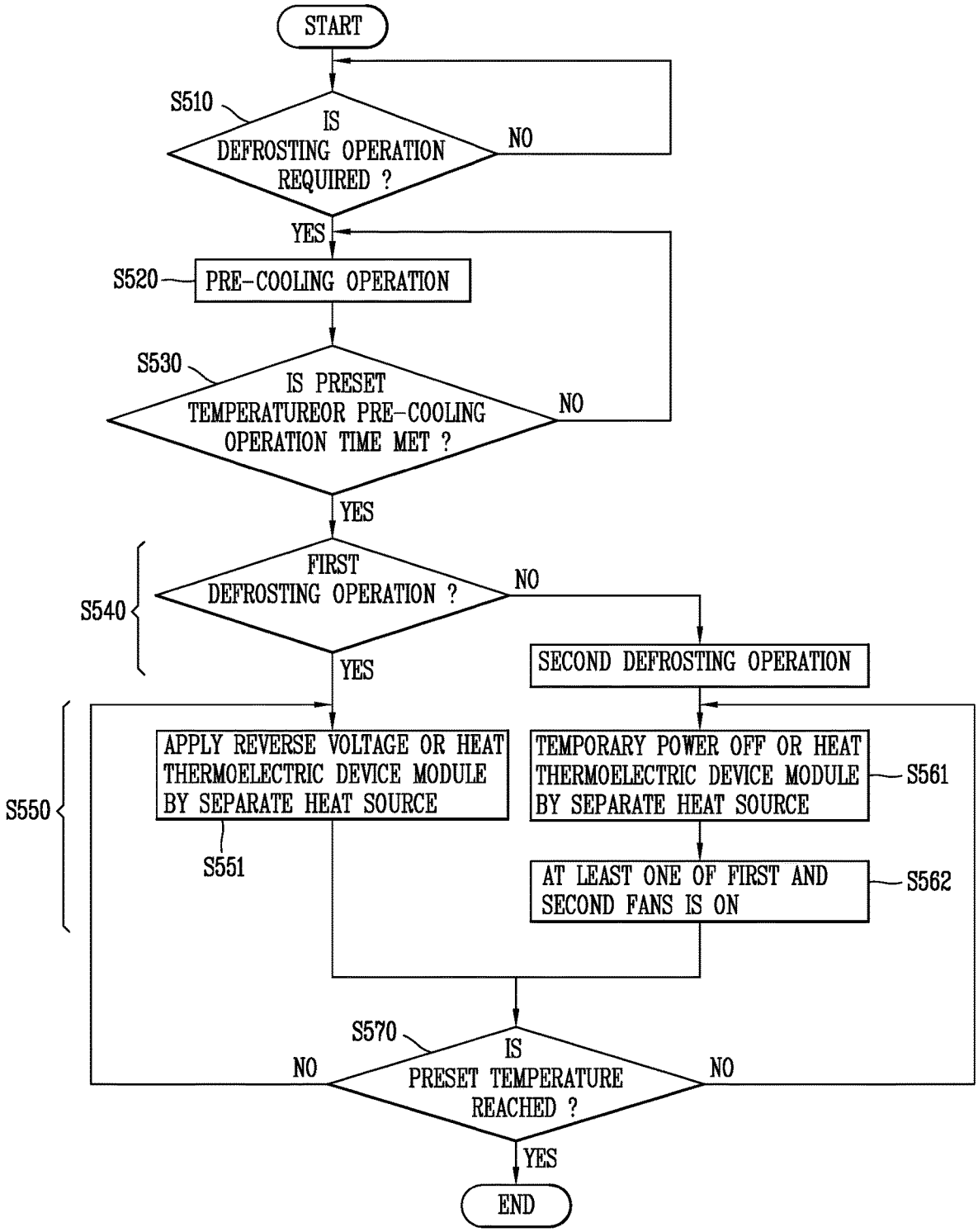
FIG. 6 is a flowchart showing the control of a defrosting operation of a refrigerator with a thermoelectric device module.

FIG. 6 is a flowchart showing the control of a defrosting operation of a refrigerator with a thermoelectric device module. First, it is determined whether a defrosting operation is required (S510). When the thermoelectric device module runs continuously or cumulatively for a prescribed amount of time, frost may form on the first heat sink. The defrosting process refers to an operation of removing the built up frost.

The controller 180 may be configured to start a defrosting operation based on the temperature or humidity of the storage compartment measured by the sensor unit 191, 192, 193, 194, and 195 or the cumulative operating time of the thermoelectric device module 170. For example, if the thermoelectric device module has run continuously or cumulatively for a preset amount of time after a previous defrosting operation, it is expected that frost will form on the thermoelectric device module. Thus, the defrosting operation may be performed.

If the air pressure of the first fan is too low, it is expected that frost will form or has formed on the first heat sink. Thus, the defrosting operation may be performed. The air pressure of the first fan may be measured by the sensor unit.

Once the defrosting operation is started, the thermoelectric device module may perform a pre-cooling operation (S520). In the pre-cooling operation, the power to the thermoelectric device module may not be immediately cut-off, but may sequentially decrease the output power of the thermoelectric device to 0 (e.g., 0V).

Next, it is determined whether the pre-cooling operation is complete (S530). If the temperature of the thermoelectric device module measured by the defrosting temperature sensor reaches a preset temperature or a preset amount of pre-cooling operation time (e.g., 30 minutes) elapses, it may be determined that the pre-cooling operation has completed.

Upon completion of the pre-cooling operation, either a first defrosting operation (first defrost mode) or a second defrosting operation (second defrost mode) is selected based on the outside temperature or the temperature of the thermoelectric device module (S540). The first defrosting operation may be selected when rapid cooling is required and natural defrosting alone is not enough. The second defrosting operation may be selected when rapid cooling is not required.

A criteria for selecting the first defrosting operation or the second defrosting operation may include the outside temperature. If the outside temperature measured by the sensor unit is equal to or lower than a reference defrosting temperature (e.g., <12° C. as in Tables 3 and 4), the first defrosting operation may be selected. At lower outside temperatures, rapid cooling is required since frost may more easily be formed.

On the contrary, if the outside temperature measured by the sensor unit is higher than the reference defrosting temperature (e.g., >12° C. as in Tables 3 and 4), the second defrosting operation may be selected. At higher outside temperatures, frost may not form as easily.

Meanwhile, the defrosting operation may be selected based on the temperature of the thermoelectric device module measured by the defrosting temperature sensor. If the temperature of the thermoelectric device module measured by the defrosting temperature sensor is equal to or lower than a reference defrosting temperature (e.g., −10° C.), the first defrosting operation may be selected. When the thermoelectric device module is at lower temperatures, rapid cooling may be required since frost may more easily be formed.

On the contrary, if temperature of the thermoelectric device module measured by the defrosting temperature sensor is higher than a reference defrosting temperature (e.g., −10° C.), the second defrosting operation is selected. When the temperature of the thermoelectric device module is higher, frost may not form as easily.

To distinguish between different reference defrosting temperatures, the reference defrosting temperature for selecting the defrosting operation based on the outside temperature measured by the sensor unit may be referred to as a first reference defrosting temperature, and the reference defrosting temperature for selecting the defrosting operation based on the temperature of the thermoelectric device measured by the defrosting sensor unit may be referred to as a second reference defrosting temperature.

Referring again to FIG. 6, the defrosting operation may be performed in step S550 for both the first defrost operation and the second defrost operation. In the first defrosting operation, in step S551, a reverse voltage may be applied to the thermoelectric device, or the thermoelectric device module may be heated by a separate heat source. When a reverse voltage (e.g., a negative voltage) is applied to the thermoelectric device, the heat absorption side and the heat generation side are reversed and heat is therefore transferred to the first heat sink. The separate heat source refers to a heat source other than the thermoelectric device module—for example, a heater.

The reverse voltage applied to the thermoelectric device may be constant regardless of the set temperature input by the user. Referring to Tables 3 and 4 below, the reverse voltage remains constant at −10V, regardless of whether it is the first set temperature N1 (Table 3) or the second set temperature N2 (Table 4). Also, it can be seen that, in the defrosting operation, the Hot/Cool section is marked as Hot because of the reverse voltage.

TABLE 3

| | Condition (first set temperature N1) | | | | |
|---|---|---|---|---|---|
| | Hot/Cool | RT <12° C. | RT >12° C. | RT >18° C. | RT >27° C. |
| Defrosting operation | Hot | −10 V | 0 V | 0 V | 0 V |
| Initial operation after TEM OFF | Cool | +5 V/+8 V/+Desired voltage (30 second intervals) | | | |

TABLE 4

| | Condition (second set temperature N2) | | | | |
|---|---|---|---|---|---|
| | Hot/Cool | RT <12° C. | RT >12° C. | RT >18° C. | RT >27° C. |
| Defrosting operation | Hot | −10 V | 0 V | 0 V | 0 V |
| Initial operation after TEM OFF | Cool | +5 V/+8 V/+Desired voltage (30 second intervals) | | | |

In the first defrosting operation, in step S551, the first fan and the second fan may be controlled to keep spinning. The first fan and the second fan may keep spinning as long as a reverse voltage is applied to the thermoelectric device. When the reverse voltage is applied to the thermoelectric device, the first fan and the second fan should be controlled to continue to spin in order to facilitate heat transfer through the first and second heat sinks. With the reverse voltage applied to the thermoelectric device, the defrosting efficiency can be improved when compared to, for example, natural defrosting.

In the second defrosting operation, in step S561, natural defrosting is carried out by leaving the thermoelectric device in a stopped state, or the thermoelectric device module is heated by a separate heat source. However, the amount of heat supplied by the separate heat source in the second defrosting operation may be smaller than the amount of heat supplied by the separate heat source in the first defrosting operation. Accordingly, when the second defrosting operation is selected, power consumption may be reduced.

In the second defrosting operation, at least one of the first or second fans may be controlled to keep spinning. Here, at least one of the first or second fans may keep spinning as long as the thermoelectric device is stopped from running.

For example, in the second defrosting operation, the thermoelectric device may stop running, and the first fan may keep spinning, while the second fan may be controlled to temporarily stop running. The temporary stopping means that the second fan will spin again after a certain amount of time. For example, the second may be operated periodically or intermittently. In this case, the second fan may resume spinning while the thermoelectric device is in the stopped state and the first fan keeps spinning (S562).

In another example, when the internal temperature of the refrigerator is within the first temperature region and the thermoelectric device stops running, the first fan and the second fan may be operated to keep spinning. If the temperature of the storage compartment is in the first temperature region, this may indicate that the temperature of the storage compartment is sufficiently low to cause frost to be easily formed. Therefore, it may be desirable that both the first and second fans are controlled to keep spinning in order to achieve reduction in power consumption and quicker defrosting by natural defrosting.

If the outside temperature measured by the sensor unit is equal to or lower than a reference defrosting temperature (e.g., 12° C. as in Tables 3 and 4), the first defrosting operation may be selected. In this case, a reverse voltage is applied to the thermoelectric device. If the outside temperature measured by the sensor unit is higher than the reference defrosting temperature (e.g., 12° C. as in Tables 3 and 4), the second defrosting operation may be selected. In this case, the thermoelectric device may be stopped from running to undergo natural defrosting. The thermoelectric device module may also be heated by a separate heat source.

If the temperature of the thermoelectric device module measured by the defrosting temperature sensor is equal to or lower than a reference defrosting temperature (e.g., −10° C.), the first defrosting operation may be selected. In this case, a reverse voltage may be applied to the thermoelectric device, or the thermoelectric device module may be heated by a separate heat source. On the contrary, if temperature of the thermoelectric device module measured by the defrosting temperature sensor is higher than a reference defrosting temperature (e.g., −10° C.), the second defrosting operation may be selected. In this case, the thermoelectric device may stop running, and frost may be removed by natural defrosting.

Completion of the defrosting operation may be determined based on temperature (S570). When the temperature of the defrosting temperature sensor mounted to the thermoelectric device module reaches a preset temperature (e.g., 5° C.), the defrosting operation may be finished.

Figure 7:
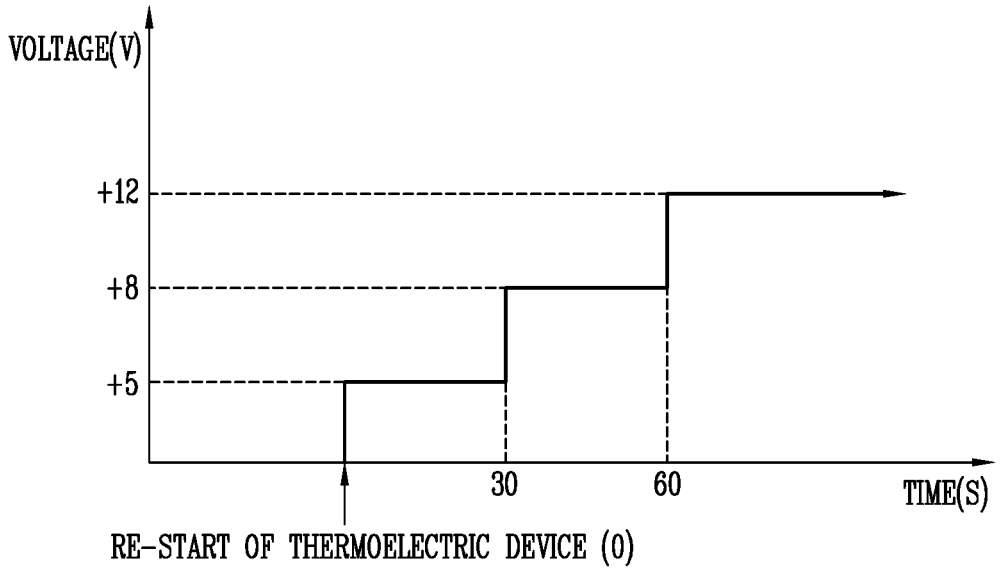
FIG. 7 is a graph showing changes in voltage applied when the thermoelectric device is restarted.

Hereinafter, changes in voltage applied when the thermoelectric device is restarted after stopping running will be described. Referring again to Tables 3 and 4, the voltage applied to the thermoelectric device module may be varied when the thermoelectric device is restarted after being stopped. FIG. 7 is a graph showing changes in voltage applied when the thermoelectric device is restarted.

The thermoelectric device may resume operation when (a) initial power is supplied to the refrigerator, (b) after the temperature of the storage compartment reaches a set temperature input by the user in the first temperature region (e.g., 0V in Table 1), the temperature then rises to enter the second temperature region, or (c) natural defrosting is completed.

When the thermoelectric device resumes operation, the controller may increase the voltage applied to the thermoelectric device gradually with time so as to increase the output power of the thermoelectric device gradually until a desired output power is reached. For example, if the desired output power is +12V, a desired voltage corresponding to the desired output power is +12V. When the thermoelectric device resumes operation, the voltage applied to the thermoelectric device may be increased gradually to +5V, +8V, and +12V at 30-second time intervals between each stage, rather than immediately increasing the voltage from 0V to +12V.

If the desired output power is the third output power +22V corresponding to the highest output power of the thermoelectric device, the number of stages may be increased. For example, the voltage applied to the thermoelectric device may be increased gradually to +5V, +8V, +12V, +16V, and +22V.

To achieve cooling using the thermoelectric device, it should be ensured that sufficient heat dissipation exists at the heat generation side of the thermoelectric device. In this way, there can be a temperature difference between the heat absorption side and the heat generation side, and the storage compartment can be cooled. However, the temperature difference between the heat absorption side and the heat generation side is created progressively, rather than abruptly upon application of a voltage of +12V to the thermoelectric device. Accordingly, maximum voltage may be unnecessary at early stages before the temperature difference is sufficient. Application of a voltage of +12V from the initial stage onwards means feeding too much voltage to the thermoelectric device, thus leading to wasteful power consumption.

Therefore, to reduce power consumption, the voltage applied to the thermoelectric device may be increased gradually with time to cope with the progressive creation of the temperature difference between the heat absorption side and the heat generation side.

Figure 8:
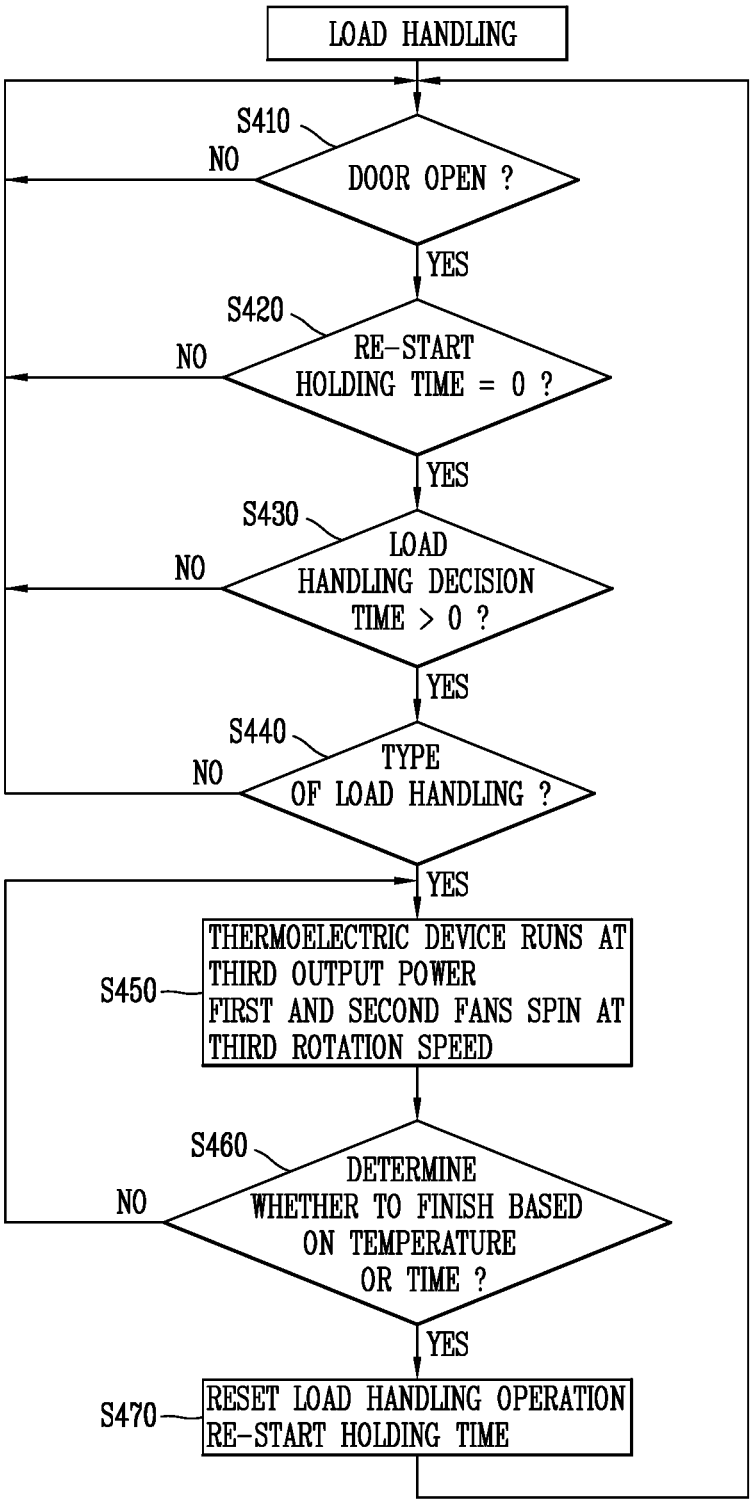
FIG. 8 is a flowchart showing the control of a load handling operation of a refrigerator with a thermoelectric device module.

FIG. 8 is a flowchart showing the control of a load handling operation of a refrigerator with a thermoelectric device module. First, it may be determined whether a door is open or not (S410). A load refers to something that requires rapid cooling of the storage compartment, for example, because the door is open or food is loaded after the door is opened. Thus, it is necessary to determine whether to perform a load handling operation after the door is opened.

If the door is detected as being open, it may be determined whether a load handling operation re-start holding time is zeroed out (S420). The re-start holding time may prevent a load handling operation from occurring for a prescribed amount of time after a load handling operation has completed. Once a load handling operation is complete and a need arises to cool the storage compartment again, a subsequent load handling operation may be prevented from starting until after a preset time. This is for preventing overcooling. When the preset time is counted down to 0, the load handling operation may be re-started.

Next, it is checked whether or not a load handling decision time is longer than 0 (S430). The load handling operation may be started only after the door is opened and then closed. For example, if the temperature of the storage compartment rises by 2° C. or more within 5 minutes after the door is closed, the load handling operation may be started. The load handling operation decision time may be counted after the door is closed. Thus, even if the temperature of the storage compartment rises by 2° C. or more compared to before the door is opened, the load handling operation may not be started unless the door is closed (e.g., the load handling decision time is 0 before the door closes). If the temperature of the storage compartment rises by a preset amount within a preset time after the door is opened and then closed, the controller starts a load handling operation.

Next, the type of load handling operation may be determined (S440). A first load handling operation may be started when hot food is loaded into the storage compartment and therefore rapid cooling is required. For example, the first load handling operation may be started when the temperature of the storage compartment rises by 2° C. or more within 5 minutes after the door is opened and closed.

A second load handling operation may be started when food having a high thermal capacity is loaded, and therefore consistent or prolonged cooling is required. For example, the second load handling operation may be started when the temperature of the storage compartment rises by 8° C. or more compared to a set temperature input by the user within 20 minutes after the door is opened and closed. If the first load handling operation is selected, the second load handling operation may be not started. If neither the first load handling operation nor the second load handling operation is selected, the controller does not start any load handling operation.

In a load handling operation, the thermoelectric device may be controlled to run at the third output power, regardless of whether the temperature of the storage compartment is in the first, second, and third temperature regions (S450). The third output power may correspond to the highest output power of the thermoelectric device.

If a load handling operation is required, this may indicate that the temperature of the storage compartment already has entered or is very likely to enter the third temperature region. Thus, the thermoelectric device may be controlled to run at the third output power for rapid cooling.

In a load handling operation, the fans may run at the third output power, regardless of whether the temperature of the storage compartment falls within the first, second, or third temperature regions. However, the third rotation speed of the first fan and the third rotation speed of the second fan may be different, and the second fan may be controlled to spin at a higher speed than the first fan.

Likewise, if a load handling operation is required, this may indicate that the temperature of the storage compartment has already entered or is very likely to enter the third temperature region. Thus, the fans may be controlled to spin at the third rotation speed for rapid cooling. This is for reducing fan noise.

Next, it may be determined whether the load handling operation has finished based on temperature or time (S460). For example, the load handling operation may be completed when the temperature of the storage compartment has dropped by a preset amount from a set temperature or a preset amount of time elapses since the start of the load handling operation. Lastly, the load handling operation re-start holding time may be reset and the timer may be started again (S470).

The thermoelectric device module as broadly described and embodied herein addresses various deficiencies. One aspect of the present disclosure is to propose a control method suitable for a refrigerator with a thermoelectric device that either cools or generates heat depending on voltage polarity, and a refrigerator controlled by this control method.

Another aspect of the present disclosure is to provide a method of controlling a refrigerator, that can control a refrigerator with a thermoelectric device in detail by using different physical properties such as temperature and humidity measured by a sensor unit, and a refrigerator controlled by this control method.

Yet another aspect of the present disclosure is to provide a control method that can achieve sufficient cooling performance, power consumption reduction, and fan noise reduction depending on temperature, and a refrigerator controlled by this control method.

An exemplary embodiment of the present disclosure provides a refrigerator which may include: a sensor unit configured to measure at least one between the temperature of a storage compartment and the outside temperature of the refrigerator; a thermoelectric device module having a thermoelectric device and at least one fan and configured to cool the storage compartment; and a controller that controls the output power of the thermoelectric device based on the temperature of the storage compartment, a set temperature input by the user, and the outside temperature, wherein the output power of the thermoelectric device is determined based on (a) the temperature of the storage compartment divided in three stages and (b) the set temperature divided in two stages.

Specifically, the output power of the thermoelectric device may be determined based on (a) which among a first temperature region including the set temperature, a second temperature region higher than the first temperature region, and a third temperature region higher than the second temperature region the temperature of the storage compartment falls within, and (b) which between a first set temperature lower than a reference set temperature and a second set temperature higher than the reference set temperature the set temperature input by the user corresponds to.

In the first temperature region, the thermoelectric device may run at a first output power which gradually increases as the outside temperature increases, in the second temperature region, the thermoelectric device may run at a second output power which gradually increases as the outside temperature increases and is higher than the first output power, and in the third temperature region, the thermoelectric device may run at a third output power which exceeds the first output power and is equal to or higher than the second output power.

The thermoelectric device module may include at least one fan, and the rotation speed of the fan may be determined based on the temperature of the storage compartment divided in three stages (a). Specifically, the rotation speed of the fan may be determined based on (a) which of the first, second, and third temperature regions the temperature of the storage compartment falls within.

In the first temperature region, the fan may spin at a first rotation speed higher than 0, in the second temperature region, the fan may spin at a second rotation speed equal to or higher than the first rotation speed, and in the third temperature region, the fan may spin at a third rotation speed which exceeds the first rotation speed and is equal or higher than the second rotation speed.

The first output power may include 0 (e.g., 0V) at which the thermoelectric device is kept in a stopped state. In the first temperature region, the first output power may increase gradually with increasing outside temperature when the outside temperature is higher than a reference outside temperature, and in the first temperature region, the thermoelectric device may be kept in a stopped state when the outside temperature is equal to or lower than the reference outside temperature. The number of gradual increases in the second output power may be higher than the number of gradual increases in the first output power in the same temperature range.

The third output power may correspond to the highest output power of the thermoelectric device, and in the third temperature region, the output power of the thermoelectric device may remain constant at the highest output power.

The first output power and the second output power may differ from each other based on which of the first and second set temperatures the set temperature corresponds, wherein, under the same outside temperature condition, the first output power applied when the set temperature corresponds to the first set temperature is equal to or higher than the first output power applied when the set temperature corresponds to the second set temperature, and under the same outside temperature condition, the second output power applied when the set temperature corresponds to the first set temperature is equal to or higher than the second output power applied when the set temperature corresponds to the second set temperature. The third output power may be constant regardless of which of the first and second set temperatures the set temperature corresponds.

In the first temperature region, when the outside temperature is equal to or lower than the reference outside temperature, the first output power may be constant regardless of which of the first and second set temperatures the set temperature corresponds.

A point at which the temperature of the storage compartment enters the second temperature region from the first temperature region may be higher than a point at which the temperature of the storage compartment enters the first temperature region from the second temperature region, and a point at which the temperature of the storage compartment enters the third temperature region from the second temperature region may be higher than a point at which the temperature of the storage compartment enters the second temperature region from the third temperature region.

The point at which the temperature of the storage compartment enters the second temperature region from the first temperature region may be higher than the set temperature input by the user, and the point at which the temperature of the storage compartment enters the first temperature region from the second temperature region may be lower than the set temperature input by the user.

The sensor unit may be configured to measure the humidity of the storage compartment or the air pressure of the fan, and the controller may be configured to start a defrosting operation based on the temperature or humidity of the storage compartment measured by the sensor unit, the air pressure of the fan measured by the sensor unit, or the cumulative operating time of the thermoelectric device module, wherein either a first defrosting operation or a second defrosting operation is selected based on the outside temperature or the temperature of the thermoelectric device module measured by a defrosting temperature sensor in the thermoelectric device module, wherein, in the first defrosting operation, a reverse voltage is applied to the thermoelectric device, or the thermoelectric device module is heated by a separate heat source, and in the second defrosting operation, the thermoelectric device is left in a stopped state, or the thermoelectric device module is heated by a separate heat source, wherein the amount of heat supplied by the separate heat source in the first defrosting operation is larger than the amount of heat supplied by the separate heat source in the second defrosting operation.

If the outside temperature measured by the sensor unit is equal to or lower than a reference defrosting temperature, the first defrosting operation may be selected. If the outside temperature measured by the sensor unit is higher than the reference defrosting temperature, the second defrosting operation may be selected to stop the operation of the thermoelectric device.

If the outside temperature measured by the sensor unit is equal to or lower than a reference defrosting temperature, the first defrosting operation may be selected to apply a reverse voltage to the thermoelectric device, and if the outside temperature measured by the sensor unit is higher than the reference defrosting temperature, the second defrosting operation may be selected to stop the operation of the thermoelectric device or heat the thermoelectric device module by the separate heat source.

If the temperature of the thermoelectric device module measured by the defrosting temperature sensor is equal to or lower than a reference defrosting temperature, the first defrosting operation may be selected. If the temperature of the thermoelectric device module measured by the defrosting temperature sensor is higher than a reference defrosting temperature, the second defrosting operation may be selected to stop the operation of the thermoelectric device.

If the temperature of the thermoelectric device module measured by the defrosting temperature sensor is equal to or lower than a reference defrosting temperature, the first defrosting operation may be selected to apply a reverse voltage to the thermoelectric device, and if the temperature of the thermoelectric device module measured by the defrosting temperature sensor is higher than the reference defrosting temperature, the second defrosting operation may be selected to stop the operation of the thermoelectric device or heat the thermoelectric device module by the separate heat source.

When the thermoelectric device in a stopped state resumes operation, the controller may increase the voltage applied to the thermoelectric device gradually with time so as to increase the output power of the thermoelectric device gradually until a desired output power is reached.

The refrigerator may further include a door configured to open or close the storage compartment, wherein, if the temperature of the storage compartment rises by a preset amount within a preset time after the door is opened and then closed, the controller may start a load handling operation, wherein, in the load handling operation, the thermoelectric device runs at the third output power, regardless of which of the first, second, and third temperature regions the temperature of the storage compartment falls within.

According to the present disclosure thus constructed, the temperature of the storage compartment, by which the output power of the thermoelectric device is determined, may be divided in three stages, which enables more detailed control compared to when the temperature of the storage compartment is divided in two stages. Specifically, in the first temperature region including a set temperature input by the user, the output power of the thermoelectric device may vary partially with the outside temperature, thereby achieving power consumption reduction. In the second temperature region, the output power of the thermoelectric device may vary completely with the outside temperature, thereby achieving both cooling performance and power consumption reduction. In the third temperature region, the thermoelectric device may run at the highest output power regardless of the outside temperature, thereby rapidly cooling the storage compartment.

In the present disclosure, apart from the temperature of the compartment, the output power of the thermoelectric device may be controlled differently depending on whether the set temperature input by the user is higher or lower than a reference set temperature. When the set temperature input by the user requires stronger cooling, the output power of the thermoelectric device may be increased; otherwise, the output power of the thermoelectric device may be decreased. As such cooling performance and power consumption reduction can be achieved.

Moreover, in the present disclosure, the rotation speed of the fans, along with the output power of the thermoelectric device, may be controlled based on the temperature of the storage compartment. Thus, with the thermoelectric device and the fans working in concert with each other, it is possible to achieve improved cooling performance, power consumption reduction, and fan noise reduction.

Furthermore, the present disclosure can achieve high defrosting efficiency and power consumption reduction and quickly handle loads by providing defrosting operation and load handling operation in a way suitable for a refrigerator with a thermoelectric device module.

This application relates to U.S. application Ser. No. 15/918,282, filed on Mar. 12, 2018, which is hereby incorporated by reference in its entirety. Further, one of ordinary skill in the art will recognize that features disclosed in these above-noted application may be combined in any combination with features disclosed herein.

The foregoing embodiments and advantages are merely exemplary and are not to be considered as limiting the present invention. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator comprising:

a plurality of sensors configured to measure a temperature inside a storage compartment and an outside temperature outside the storage compartment of the refrigerator;

a thermoelectric device module having a thermoelectric device and at least one fan and configured to cool the storage compartment; and a controller that controls the output power of the thermoelectric device based on the temperature of the storage compartment, a set temperature input by the user, and the outside temperature, wherein a specific one temperature region, from at least three temperature regions, of the storage compartment is determined based on the temperature of the storage compartment, wherein the at least three temperature regions includes:

a first temperature region which is a first range of temperatures that includes the set temperature, a second temperature region which is a second range of temperatures higher than the first range of temperatures, and a third temperature region which is a third range of temperatures higher than the second range of temperatures, wherein the output power of the thermoelectric device is determined based on:

the specific one temperature region of the storage compartment that is determined based on the temperature of the storage compartment, and the set temperature being a first set temperature lower than a reference set temperature or the set temperature being a second set temperature higher than the reference set temperature, and wherein, while the first temperature region is determined to be the specific one temperature region, the thermoelectric device is controlled to operate at a first output power which increments at least once with increasing outside temperature when the outside temperature is higher than a reference outside temperature and is maintained at 0 when the outside temperature is lower than or equal to the reference outside temperature, while the second temperature region is determined to be the specific one temperature region, the thermoelectric device is controlled to operate at a second output power which increments at least once as the outside temperature increases and is greater than the first output power, and while the third temperature region is determined to be the specific one temperature region, the thermoelectric device is controlled to operate at a third output power which corresponds to a highest output power of the thermoelectric device and exceeds the first output power and is greater than or equal to the second output power;

the third output power to be constant as the outside temperature increases, wherein the first output power and the second output power differ from each other based on whether the set temperature corresponds to the first set temperature or the second set temperature, wherein from each separate and specific outside temperature range:

(1) the first output power corresponding to the first set temperature for the specific outside temperature range is greater than or equal to the first output power corresponding to the second set temperature for the same specific for the same specific outside temperature range, and (2) the second output power corresponding to the first set temperature for the specific outside temperature range is greater than the second output power corresponding to the second set temperature for the same specific outside temperature range.

2. The refrigerator of claim 1, wherein the first output power includes a level at which the thermoelectric device is controlled to be in a stopped state.

3. The refrigerator of claim 1, wherein, in the first temperature region, the first output power increases with increasing outside temperature when the outside temperature is higher than a reference outside temperature, and in the first temperature region, the thermoelectric device is controlled to be in a stopped state when the outside temperature is lower than or equal to the reference outside temperature.

4. The refrigerator of claim 3, wherein, in the first temperature region, when the outside temperature is equal to or lower than the reference outside temperature, the first output power is constant regardless of the set temperature being the first set temperature or the set temperature being the second set temperature.

5. The refrigerator of claim 1, wherein the first output power and the second output power are incrementally increased in a prescribed number of increments, wherein a number of increases in the second output power is greater than a number of increases in the first output power in a same range of outside temperatures.

6. The refrigerator of claim 1, wherein the third output power corresponds to a highest output power of the thermoelectric device, and in the third temperature region, the output power of the thermoelectric device remains constant at the highest output power.

7. The refrigerator of claim 1, wherein the third output power is constant regardless whether the set temperature corresponds to the first set temperature or the second set temperature.

8. The refrigerator of claim 1, wherein a temperature point at which the temperature of the storage compartment enters the second temperature region from the first temperature region is higher than a point at which the temperature of the storage compartment enters the first temperature region from the second temperature region, and a point at which the temperature of the storage compartment enters the third temperature region from the second temperature region is higher than a point at which the temperature of the storage compartment enters the second temperature region from the third temperature region.

9. The refrigerator of claim 8, wherein the point at which the temperature of the storage compartment enters the second temperature region from the first temperature region is higher than the set temperature input by the user, and the point at which the temperature of the storage compartment enters the first temperature region from the second temperature region is lower than the set temperature input by the user.

10. A refrigerator comprising:

a plurality of sensors configured to measure a temperature inside a storage compartment and an outside temperature outside the storage compartment of the refrigerator;

a thermoelectric device module having a thermoelectric device and at least one fan and configured to cool the storage compartment; and a controller that controls the output power of the thermoelectric device based on the temperature of the storage compartment, a set temperature input by the user, and the outside temperature, wherein a specific one temperature region, from at least three temperature regions, of the storage compartment is determined based on the temperature of the storage compartment, wherein the at least three temperature regions includes:

a first temperature region which is a first range of temperatures that includes the set temperature, a second temperature region which is a second range of temperatures higher than the first range of temperatures, and a third temperature region which is a third range of temperatures higher than the second range of temperatures, wherein the output power of the thermoelectric device is determined based on:

the specific one temperature region of the storage compartment that is determined based on the temperature of the storage compartment, and the set temperature being a first set temperature lower than a reference set temperature or the set temperature being a second set temperature higher than the reference set temperature, and wherein, while the first temperature region is determined to be the specific one temperature region, the thermoelectric device is controlled to operate at a first output power which increments at least once with increasing outside temperature when the outside temperature is higher than a reference outside temperature and is maintained at 0 when the outside temperature is lower than or equal to the reference outside temperature, while the second temperature region is determined to be the specific one temperature region, the thermoelectric device is controlled to operate at a second output power which increments at least once as the outside temperature increases and is greater than the first output power, and while the third temperature region is determined to be the specific one temperature region, the thermoelectric device is controlled to operate at a third output power which corresponds to a highest output power of the thermoelectric device and exceeds the first output power and is greater than or equal to the second output power;

the third output power to be constant as the outside temperature increases, wherein the first output power and the second output power differ from each other based on whether the set temperature corresponds to the first set temperature or the second set temperature, wherein from each separate and specific outside temperature range:

(1) the first output power corresponding to the first set temperature for the specific outside temperature range is greater than or equal to the first output power corresponding to the second set temperature for the same specific outside temperature range, and (2) the second output power corresponding to the first set temperature for the specific outside temperature range is greater than the second output power corresponding to the second set temperature for the same specific outside temperature range, wherein a first one of the plurality of sensors is configured to measure a humidity in the storage compartment or a second one of the plurality of sensor is configured to measure an air pressure at the fan, and the controller is configured to start a defrost operation based on the temperature or humidity of the storage compartment measured by the first one of the sensors, the air pressure at the fan measured by the second one of the sensors, or a cumulative operating time of the thermoelectric device module, wherein the first one of the sensors includes a defrosting temperature sensor and the defrost operation includes a first defrost mode and a second defrost mode, either the first defrost mode or the second defrost mode being selected based on the outside temperature or the temperature of the thermoelectric device module measured by a defrosting temperature sensor in the thermoelectric device module, wherein, in the first defrost mode, a reverse voltage is applied to the thermoelectric device or the thermoelectric device module is heated by a heat source, and in the second defrost mode, the thermoelectric device is maintained in a stopped state or the thermoelectric device module is heated by the heat source, wherein an amount of heat supplied by the heat source in the first defrosting operation is greater than an amount of heat supplied by the heat source in the second defrosting operation.

11. The refrigerator of claim 10, wherein, when the outside temperature measured by a third one of the sensors is less than or equal to a reference defrosting temperature, the first defrost mode is selected.

12. The refrigerator of claim 10, wherein, when the outside temperature measured by the third one of the sensors is higher than the reference defrosting temperature, the second defrost mode is selected to stop the operation of the thermoelectric device.

13. The refrigerator of claim 10, wherein, when the outside temperature measured by the third one of the sensors is less than or equal to a reference defrosting temperature, the first defrost mode is selected to apply a reverse voltage to the thermoelectric device, and when the outside temperature measured by the third one of the sensors is higher than the reference defrosting temperature, the second defrost mode is selected to stop the operation of the thermoelectric device or heat the thermoelectric device module using the heat source.

14. The refrigerator of claim 10, wherein, when the temperature of the thermoelectric device module measured by the defrosting temperature sensor is less than or equal to a reference defrosting temperature, the first defrost mode is selected.

15. The refrigerator of claim 10, wherein, when the temperature of the thermoelectric device module measured by the defrosting temperature sensor is higher than a reference defrosting temperature, the second defrost mode is selected to stop the operation of the thermoelectric device.

16. The refrigerator of claim 10, wherein, when the temperature of the thermoelectric device module measured by the defrosting temperature sensor is less than or equal to a reference defrosting temperature, the first defrost mode is selected to apply a reverse voltage to the thermoelectric device, and when the temperature of the thermoelectric device module measured by the defrosting temperature sensor is higher than the reference defrosting temperature, the second defrost mode is selected to stop the operation of the thermoelectric device or heat the thermoelectric device module using the heat source.

17. The refrigerator of claim 1, wherein, when the thermoelectric device in a stopped state resumes operation, the controller increments at least once the voltage applied to the thermoelectric device with respect to time so as to increment the output power of the thermoelectric device at least once until a desired output power is reached.

18. The refrigerator of claim 1, further comprising a door configured to open or dose the storage compartment, wherein, when the temperature of the storage compartment rises by a prescribed amount within a prescribed amount of time after the door is opened and then closed, the controller starts a load handling operation, wherein, in the load handling operation, the thermoelectric device is controlled to operate at the third output power, regardless of whether the temperature of the storage compartment is within the first, the second, or the third temperature regions.

19. A refrigerator comprising:

a plurality of sensors configured to measure a temperature of a storage compartment and an outside temperature outside the storage compartment of the refrigerator;

a thermoelectric device module having a thermoelectric device and at least one fan and configured to cool the storage compartment; and a controller that controls the output power of the thermoelectric device based on the temperature of the storage compartment, a set temperature input by the user, and the outside temperature, wherein a specific one temperature region, from at least three temperature regions, of the storage compartment is determined based on the temperature of the storage compartment, wherein the at least three temperature regions includes:

a first temperature region which is a first range of temperatures that includes the set temperature, a second temperature region which is a second range of temperatures higher than the first range of temperatures, and a third temperature region which is a third range of temperatures higher than the second range of temperatures, wherein the output power of the thermoelectric device is determined based on:

the specific one temperature region of the storage compartment that is determined based on the temperature of the storage compartment, and the set temperature being a first set temperature lower than a reference set temperature or the set temperature being a second set temperature higher than the reference set temperature, wherein a rotation speed of the fan is determined based on whether the temperature of the storage compartment is within the first, the second, or the third temperature regions, and wherein, while the first temperature region is determined to be the specific one temperature region, the thermoelectric device is controlled to operate at a first output power which increases as the outside temperature increases, and in the first temperature region, the fan is controlled to operate at a first rotation speed greater than 0 RPM, while the second temperature region is determined to be the specific one temperature region, the thermoelectric device is configured to operate at a second output power which increases as the outside temperature increases and is greater than the first output power, and in the second temperature region, the fan is controlled to operate at a second rotation speed greater than or equal to the first rotation speed, and while the third temperature region is determined to be the specific one temperature region, the thermoelectric device is controlled to operate at a third output power which greater than the first output power and is greater than or equal to the second output power, and in the third temperature region, the fan is controlled to operate at a third rotation speed which is greater than the first rotation speed and is greater than or equal to the second rotation speed, and wherein the first output power and the second output power differ from each other based on whether the set temperature corresponds to the first set temperature or the second set temperature, wherein from each separate and specific outside temperature range:

(1) the first output power corresponding to the first set temperature for the specific outside temperature range is greater than or equal to the first output power corresponding to the second set temperature for the same specific outside temperature range, and (2) the second output power corresponding to the first set temperature for the specific outside temperature range is greater than the second output power corresponding to the second set temperature for the same specific outside temperature range.

* * * * *